US010266189B2

(12) United States Patent
Echizen et al.

(10) Patent No.: US 10,266,189 B2
(45) Date of Patent: Apr. 23, 2019

(54) INTERLOCKING DEVICE

(71) Applicant: EAST JAPAN RAILWAY COMPANY, Tokyo (JP)

(72) Inventors: Kazuhisa Echizen, Tokyo (JP); Hiroshi Abe, Tokyo (JP); Katsuichiro Awano, Saitama (JP)

(73) Assignee: EAST JAPAN RAILWAY COMPANY, Tokyo (JP)

( * ) Notice: Subject to any disclaimer, the term of this patent is extended or adjusted under 35 U.S.C. 154(b) by 157 days.

(21) Appl. No.: 15/328,702

(22) PCT Filed: Jul. 30, 2015

(86) PCT No.: PCT/JP2015/071617

§ 371 (c)(1),
(2) Date: Jan. 24, 2017

(87) PCT Pub. No.: WO2016/017740

PCT Pub. Date: Feb. 4, 2016

(65) Prior Publication Data

US 2017/0217461 A1 Aug. 3, 2017

(30) Foreign Application Priority Data

Jul. 31, 2014 (JP) ..... 2014-156489

(51) Int. Cl.
*B61L 19/06* (2006.01)
*B61L 21/04* (2006.01)
(Continued)

(52) U.S. Cl.
CPC ..... *B61L 27/0027* (2013.01); *B61L 19/06* (2013.01); *B61L 21/04* (2013.01); *B61L 21/06* (2013.01);
(Continued)

(58) Field of Classification Search
CPC ..... B61L 19/06; B61L 27/0027; B61L 21/04; B61L 21/06; B61L 21/10; B61L 21/16; B61L 23/16; B61L 25/025; B61L 25/04
See application file for complete search history.

(56) References Cited

U.S. PATENT DOCUMENTS 4,305,556 A * 12/1981 Norton ..... B61L 1/20 246/167 R
5,390,880 A * 2/1995 Fukawa ..... B61L 27/0055 246/167 R
(Continued)

FOREIGN PATENT DOCUMENTS

EP 0822909 A1 2/1998
EP 2738061 A1 6/2014
(Continued)

OTHER PUBLICATIONS

Oct. 20, 2015 International Search Report issued in International Patent Application No. PCT/JP2015/071617.
(Continued)

*Primary Examiner* — Jason C Smith
(74) *Attorney, Agent, or Firm* — Oliff PLC

(57) ABSTRACT

An interlocking device performs route control for trains based on: first operation diagram information as train operation diagram information on a train which runs between stations; second operation diagram information as train operation diagram information on a train which moves in a station yard; and on-track position information on the trains. The interlocking device performs control with time on a signal and/or a switch on a route of a train based on different information according to whether a predetermined condition is satisfied.

3 Claims, 18 Drawing Sheets

(51) Int. Cl.

| | |
|---|---|
| ***B61L 21/06*** | (2006.01) |
| ***B61L 21/10*** | (2006.01) |
| ***B61L 23/16*** | (2006.01) |
| ***B61L 25/02*** | (2006.01) |
| ***B61L 25/04*** | (2006.01) |
| ***B61L 27/00*** | (2006.01) |

(52) U.S. Cl.

CPC ..... *B61L 21/10* (2013.01); *B61L 23/16* (2013.01); *B61L 25/025* (2013.01); *B61L 27/0077* (2013.01); *B61L 25/04* (2013.01); *B61L 2019/065* (2013.01); *B61L 2201/00* (2013.01)

(56) References Cited

U.S. PATENT DOCUMENTS

| | | | | |
|---|---|---|---|---|
| 2011/0060938 | A1* | 3/2011 | Ling | B61L 19/06 714/3 |
| 2015/0344050 | A1* | 12/2015 | Yanai | B61L 21/04 246/3 |
| 2016/0039437 | A1* | 2/2016 | Miyajima | B60L 15/40 701/19 |
| 2016/0039438 | A1* | 2/2016 | Miyajima | B60L 15/40 701/19 |
| 2016/0046306 | A1* | 2/2016 | Miyajima | B60L 15/40 701/19 |
| 2017/0210402 | A1* | 7/2017 | Echizen | B61L 19/06 |
| 2017/0217461 | A1* | 8/2017 | Echizen | B61L 19/06 |

FOREIGN PATENT DOCUMENTS

| | | | | | |
|---|---|---|---|---|---|
| GB | 2497228 | A | * | 6/2013 | B61L 27/0027 |
| GB | 2497228 | A | | 6/2013 | |
| JP | H04-197874 | A | | 7/1992 | |
| JP | 2000-168559 | A | | 6/2000 | |
| JP | 3053802 | B1 | | 6/2000 | |
| JP | 2000-190849 | A | | 7/2000 | |
| JP | 3410322 | B2 | | 5/2003 | |
| JP | 2005-035493 | A | | 2/2005 | |
| JP | 2010-228608 | A | | 10/2010 | |
| JP | 2013-193539 | A | | 9/2013 | |
| WO | 2005/007483 | A1 | | 1/2005 | |
| WO | WO-2005007483 | A1 | * | 1/2005 | B61L 17/00 |
| WO | 2010/063245 | A2 | | 6/2010 | |

OTHER PUBLICATIONS

Oct. 26, 2017 Search Report issued in European Patent Application No. 15827461.3.

Jul. 10, 2017 Search Report issued in European Patent Application No. 15827461.3.

Friedhelm Schlender. "Zugnummernmeldeanlage Für Relais—Und Mechanische Stellwerke". Signal + Draht, DVV, vol. 101, No. 4, Apr. 1, 2009, pp. 24-28.

Jan. 31, 2017 International Preliminary Report on Patentability issued in International Patent Application No. PCT/JP2015/071617.

* cited by examiner

INTERLOCKING DEVICE

TECHNICAL FIELD

The present invention relates to an interlocking device which performs route control for trains.

BACKGROUND ART

There has been known an interlocking device which, according to given required route setting information or the like, opens a desired route by switching a switch(es) to one side from another provided at a diverging point(s) (point(s)) of railway tracks, and automatically performs operation, for example, to indicate on a signal(s) that the route is opened. (Refer to, for example, Patent Document 1.) Here, the "diverging point (point)" is a place where a switch is provided, exemplified by a crossing point, a meeting point and a diverging point of railway tracks.

RELATED ART DOCUMENTS

Patent Documents

Patent Document 1: Japanese Patent Application Publication No. 4-197874

SUMMARY OF THE INVENTION

Problems to be Solved by the Invention

A conventional interlocking device performs control with time on signals and/or switches based on the same information, no matter whether a predetermined condition is satisfied. Although there is no problem as long as no train delay occurs, once train delay occurs, a problem arises, for example, that smooth train operation cannot be performed.

The present invention has been conceived in view of the above circumstances, and objects of the present invention include providing an interlocking device which can realize smooth train operation.

Means for Solving the Problems

In order to achieve the object(s) of the present invention, an interlocking device of the present invention is an interlocking device which performs route control for trains based on: first operation diagram information as train operation diagram information on a train which runs between stations; second operation diagram information as train operation diagram information on a train which moves in a station yard; and on-track position information on the trains, wherein the interlocking device performs control with time on a signal and/or a switch on a route of a train based on different information according to whether a predetermined condition is satisfied.

Hence, smooth train operation can be realized.

Preferably, in the interlocking device, the second operation diagram information contains: starting time as time at which a train leaves a start point of an entry/departure route as a route of the train entering or departing from a vehicle depot; and through time as time at which the train passes through a predetermined through place provided between the start point and an end point of the entry/departure route, and the interlocking device: determines whether the condition is satisfied, wherein the condition is that the through place for which through time is set is provided in the entry/departure route; and when determining that the condition is not satisfied, controls the signal and/or the switch in a section from the start point to the end point based on the starting time; and when determining that the condition is satisfied, controls the signal and/or the switch in a section from the start point to the through place based on the starting time, and controls the signal and/or the switch in a section from the through place to another through place or in a section from the through place to the end point based on the through time.

By this configuration, quality of depot entry/departure control can be improved using the existing information (through time).

Alternatively, the interlocking device includes a register unit to register an order of departure from a predetermined station, wherein if the order registered in the register unit is a first train and a second train, and the first train and the second train depart from tracks having different numbers, pass through a same diverging point and proceed in a same direction, the interlocking device: determines whether the condition is satisfied, wherein the condition is that a plurality of starting signals is provided both between a departure point of the first train and the diverging point and between a departure point of the second train and the diverging point, and routes of the first train and the second train are pre-specified routes; and when determining that the condition is not satisfied, controls, based on the order registered in the register unit, the plurality of starting signals provided between the departure point of the second train and the diverging point after the first train passes through a last starting signal among the plurality of starting signals provided between the departure point of the first train and the diverging point; and when determining that the condition is satisfied, controls the plurality of starting signals provided between the departure point of the second train and the diverging point based on departure time of the second train without waiting for the first train to pass through the last starting signal among the plurality of starting signals provided between the departure point of the first train and the diverging point.

By this configuration, the second train can depart as scheduled.

Alternatively, in the interlocking device, if a plurality of shunting signals is provided on a departure route as a route of a departing train which departs from a vehicle depot, the interlocking device: determining whether the condition is satisfied, wherein the condition is that the plurality of shunting signals includes a specific shunting signal to make the departing train make a stop; and when determining that the condition is not satisfied, controls the plurality of shunting signals provided on the departure route based on the second operation diagram information; and when determining that the condition is satisfied, controls the specific shunting signal based on the on-track position information on the departing train and an entry state of the departing train into a predetermined track circuit, and controls the plurality of shunting signals except the specific shunting signal based on the second operation diagram information.

By this configuration, the specific shunting signal can be controlled at appropriate timing.

Advantageous Effects of the Invention

The present invention can realize smooth train operation.

EMBODIMENTS FOR CARRYING OUT THE INVENTION

Embodiments of an interlocking device of the present invention are described with reference to the drawings. On the embodiments described below, a variety of limitations which are technically preferred to carry out the present invention are put. However, the scope of the present invention is not limited to the embodiments below or illustrated examples.

Figure 1:
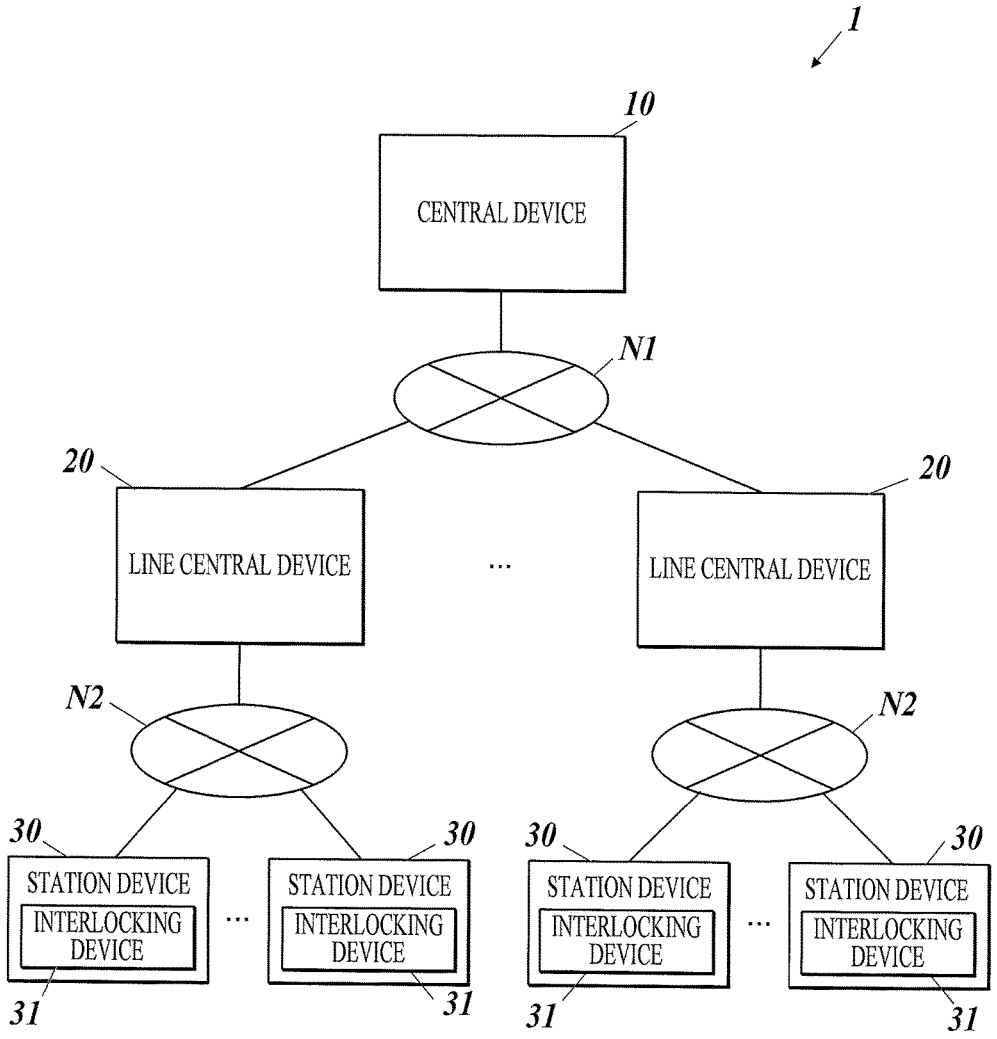
FIG. 1 is a block diagram showing the main part of the whole train operation control system including interlocking devices according to embodiments.

FIG. 1 shows the overall configuration of a train operation control system 1 including interlocking devices 31 according to embodiments of the present invention.

The train operation control system 1 is used by high-density traffic lines having multiple tracks, and as shown in FIG. 1 as an example, mainly includes: a central device (central device common to lines) 10; line central devices 20 for respective lines; station devices 30 installed in interlocking stations provided with interlocking devices which control signals, switches and so forth; information terminals (not shown) installed in single-track and single-platform stations provided with no diverged tracks, namely, no diverging points (no interlocking devices); a central network N1 which makes the central device 10 and the line central devices 20 communicable with one another; and operation control networks N2 for respective lines, each of the networks N2 making a line central device 20 for one line, station devices 30 installed in interlocking stations in the one line and information terminals (not shown) installed in single-track and single-platform stations in the one line communicable with one another.

The central device 10 is, for example, used in common by the lines adopting the train operation control system 1 (adopting lines), and includes, in addition to core devices (a system monitoring device, a facility maintenance dispatcher console, a maintenance work management device, a central information terminal, an information transmitting device, etc.) of the train operation control system 1, a device (a scheduled operation diagram management device or the like) which manages scheduled operation diagram information on the adopting lines and daily distributes the respective scheduled operation diagram information to the respective line central devices 20, and a device (a passenger service dispatcher console or the like) which performs passenger services.

The line central devices 20 are, for example, used by respective adopting lines, and each include a train dispatcher console which inputs train traffic rescheduling (work to change actual operation diagram information) when train delay or the like occurs in the target line, and receives line occupation information on the target line at intervals of a predetermined time (e.g., four seconds) from the station devices 30 and displays positions of trains on tracks.

Each line central device 20 is configured to distribute actual operation diagram information and depot entry/departure operation diagram information at intervals of a predetermined time (e.g., four seconds).

Operation diagram information includes main track operation diagram information as train operation diagram information on trains which run on main tracks between stations and depot entry/departure operation diagram information as train operation diagram information on trains which move inside station yards (vehicles entering vehicle depots and vehicles departing from vehicle depots, etc.), and the scheduled operation diagram information and the actual operation diagram information are of the main track operation diagram information. That is, the scheduled operation diagram information is main track operation diagram information created based on a basic operation diagram, and the actual operation diagram information is main track operation diagram information created based on the scheduled operation diagram information and changed operation diagram information.

The station devices 30 are, for example, used by respective interlocking stations and each perform route control, passenger guidance and so forth based on the information from the line central device(s) 20 and so forth. More specifically, each station device 30 mainly includes, as shown in FIG. 1 as an example: an interlocking device 31 which controls a signal device controller which sends/receives signals to/from signal devices, such as signals, switches, track circuits and ATS (Automatic Train Stop(s)); a system terminal (not shown), such as an X terminal; and a passenger guidance device (not shown) which controls departure indicators, an automatic announcement device and so forth.

The interlocking device 31 includes: as safety equipment, an interlocking-system device which controls operation of signals, switches and so forth, and interlocks operation of the signals, the switches and so forth so as not to build unexpected routes as routes of trains; and a route-control-system device which controls the interlocking-system device based on information stored in advance and information from the line central device 20, track circuits and so forth such that trains can run as scheduled.

That is, the interlocking device 31 determines the order of departure (departure order) from a station or a platform(s) in a target area, the order of passing through a point (diverging point) (crossing order) in the target area, and so forth based on: the main track operation diagram information (actual operation diagram information) and the depot entry/departure operation diagram information from the line central device 20; on-track position information on trains/vehicles from the track circuits; and shape of railway tracks (railway track layout) in the target area and so forth which the interlocking device 31 stores in advance, registers the determined orders, and performs route control for trains in accordance with the registered orders.

Here, the "control(s) (operation of) signals" includes: control to switch signals to the "proceed" side and return the signals to the "stop" side when trains pass through the signals; and control to keep signals on the "stop" side.

Further, the "control(s) (operation of) switches" includes: control to switch switches to the "reverse position" side and return the switches to the "normal position" side when trains pass through the switches; and control to keep switches on the "normal position" side.

<Route Control Process>

Figure 2:
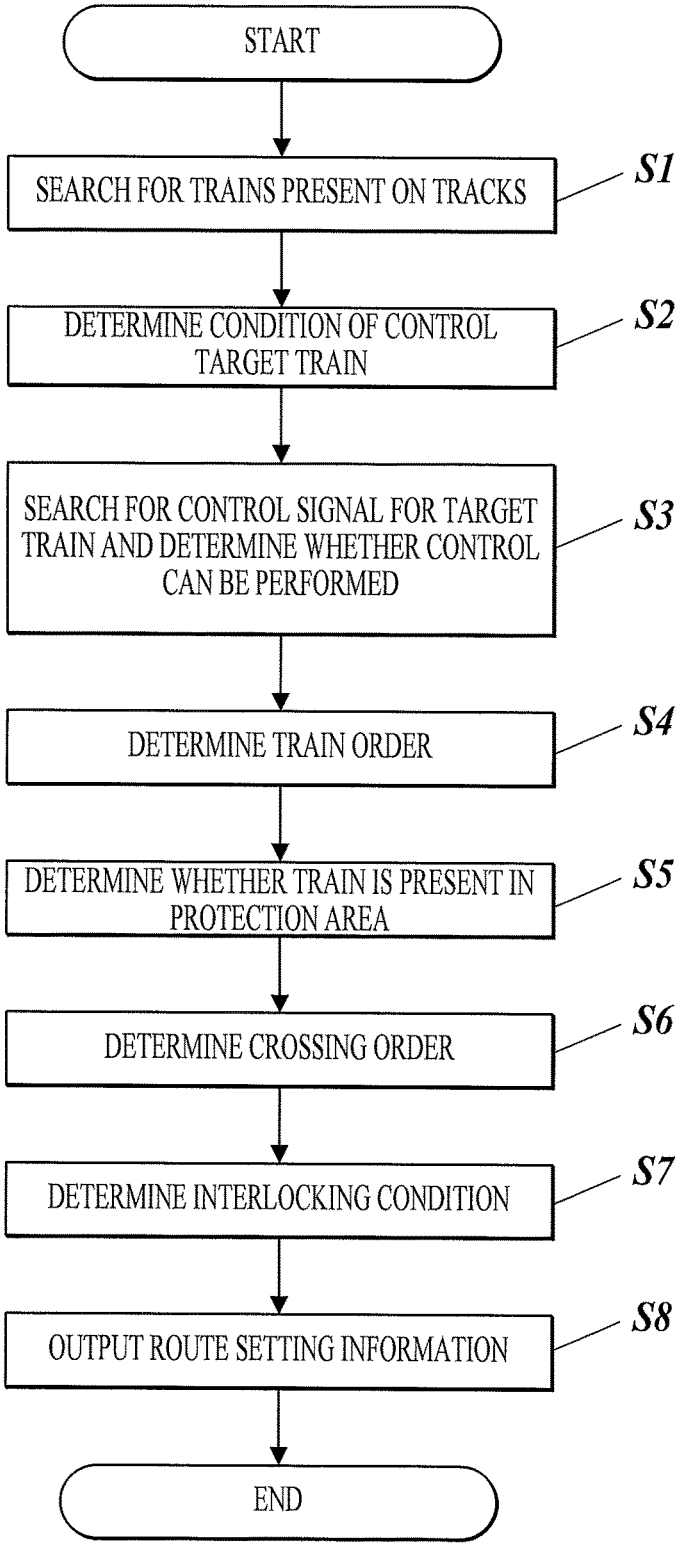
FIG. 2 is a flowchart to explain a route control process in each interlocking device according to embodiments.

A route control process performed by the interlocking device 31 (the route-control-system device of the interlocking device 31, to be specific) is described. FIG. 2 is a flowchart showing an example of the route control process according to embodiments.

First, the interlocking device 31 searches for trains present on tracks in the target area, and grasps positions of the trains present on the tracks (Step S1).

Next, the interlocking device 31 determines conditions (control points, time, etc.) of a control target train (Step S2).

Next, the interlocking device 31 searches for control signal(s) for the control target train, checks suspended operation, operation when instructed, maintenance work and so forth, and determines whether control can be performed (Step S3).

Next, the interlocking device 31 determines the train order and defers the control until the control target train ranks No. 1 therein (Step S4). Here, the "train order" means the order in which trains are controlled, the order being determined based on the actual operation diagram information.

Next, the interlocking device 31 performs a protection area train presence determination process to check whether a train(s) is present in an area (an inner side) protected by a signal, namely, in a section(s) ahead of a signal which is performing indication (hereinafter called the "protection area") (Step S5).

Next, the interlocking device 31 performs a crossing order determination process to check the order of using a point (crossing order) (Step S6).

Next, the interlocking device 31 performs an interlocking condition determination process to check output of the interlocking system (the interlocking-system device of the interlocking device 31, to be specific) (Step S7).

Next, the interlocking device 31 outputs route setting information (Step S8) and then ends the route control process. Further, the interlocking device 31 (the route-control-system device of the interlocking device 31, to be specific) can check a refusal response (logical contrary) from the interlocking system (the interlocking-system device of the interlocking device 31, to be specific) and output the route setting information again.

<Crossing Order Determination Process>

Figure 3:
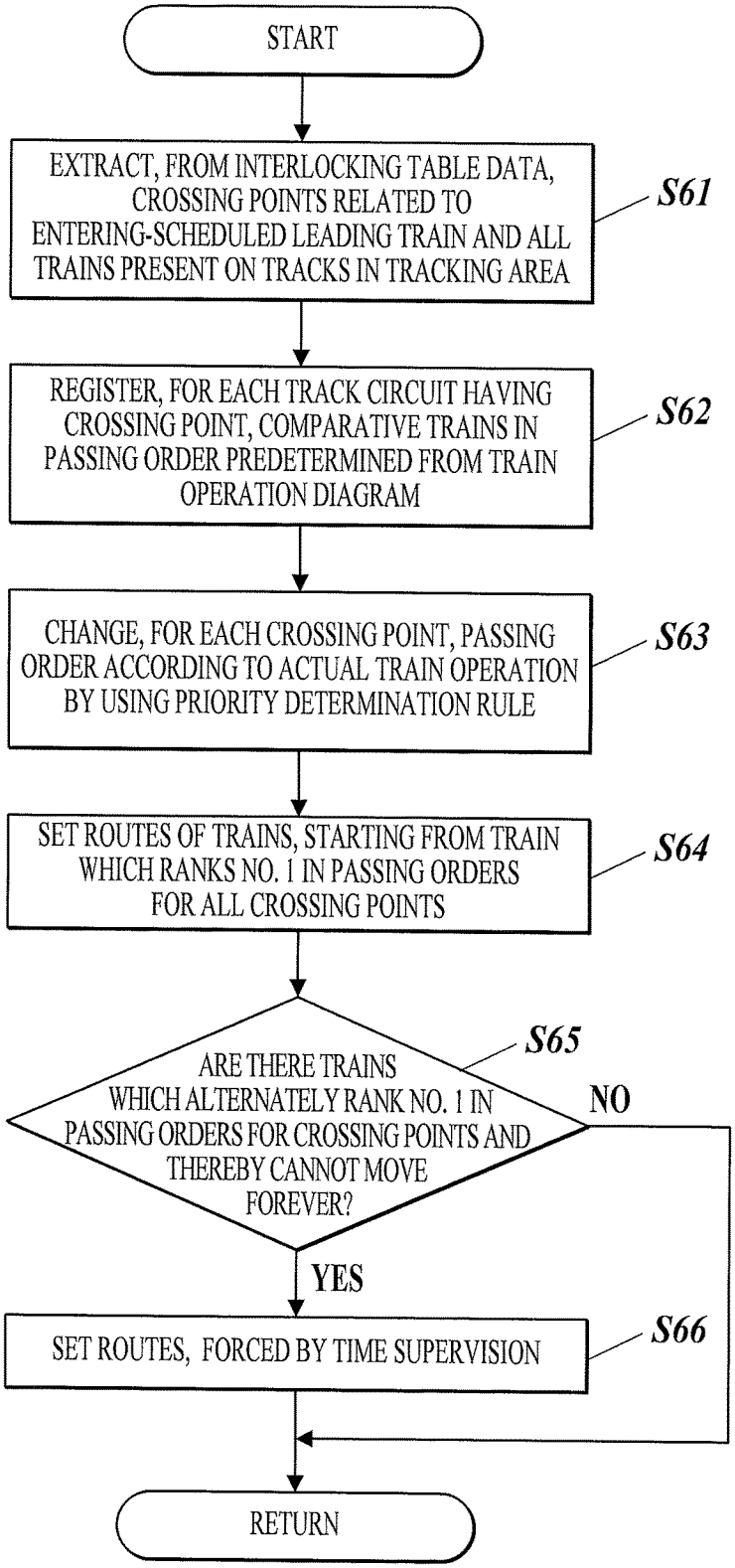
FIG. 3 is a flowchart to explain a crossing order determination process in each interlocking device according to embodiments.

Next, the crossing order determination process (Step S6) is described in detail. FIG. 3 is a flowchart showing an example of the crossing order determination process according to embodiments. In the following description of the crossing order determination process, for convenience, the "point (a place where a switch is provided, exemplified by a crossing point, a meeting point and a diverging point of railway tracks) may be called the "crossing point".

First, the interlocking device 31 extracts, from interlocking table data, crossing points (points) related to an entering-scheduled leading train and all trains present on tracks in the tracking area (target area) (Step S61).

Next, the interlocking device 31 registers, for each track circuit having a crossing point, competitive trains in the passing order predetermined based on the train operation diagram (the main track operation diagram information (actual operation diagram information), the depot entry/departure operation diagram information, etc.) (Step S62).

Next, the interlocking device 31 changes, for each crossing point, the passing order according to the actual train operation by using a priority determination rule (Step S63).

Next, the interlocking device 31 sets routes of trains, starting from the train which ranks No. 1 in the passing orders (crossing orders) for all the crossing points (Step S64).

Next, the interlocking device 31 determines whether there are trains which alternately rank No. 1 in the passing orders for the crossing points and thereby cannot move forever (Step S65).

When determining that there are no trains which cannot move forever at Step S65 (Step S65; NO), the interlocking device 31 ends the crossing order determination process.

On the other hand, when determining that there are trains which cannot move forever (Step S65; YES), the interlocking device 31 sets routes of the trains, forced by time supervision (Step S66) and then ends the crossing order determination process.

Next, order determination functions 1 to 7, route control functions 1 and 2 and train tracking functions 1 to 5, which are features of the interlocking device 31 of the present invention, are described.

<Order Determination Function 1>

There has been a problem that, by input of train traffic rescheduling, route control for a connection $2^{nd}$ departing vehicle (a connecting vehicle) is prevented by another train having been scheduled to arrive at a place of a track number (line number) where a connection $1^{st}$ train (a connected train) is currently present. That is, there has been a problem that if, before the connection $2^{nd}$ train (Train-OA), another train (Train-B) makes a route booking for the track number where the connection $1^{st}$ train (Train-A) is currently present, a deadlock is caused by the Train-OA and the Train-B.

Hence, in an embodiment, an order determination function 1 is provided which allows route control for a connecting vehicle by ignoring the crossing order when a connected train is already present on the track. That is, the order determination function 1 is provided which allows route control for the connection $2^{nd}$ train by ignoring the crossing order when the connection $1^{st}$ train is already present on the track.

Here, the "connection" means coupling a plurality of trains with one another so as to form one train. Further, the "departing vehicle" means a vehicle departing from a vehicle depot and going to a main track.

Figure 4:
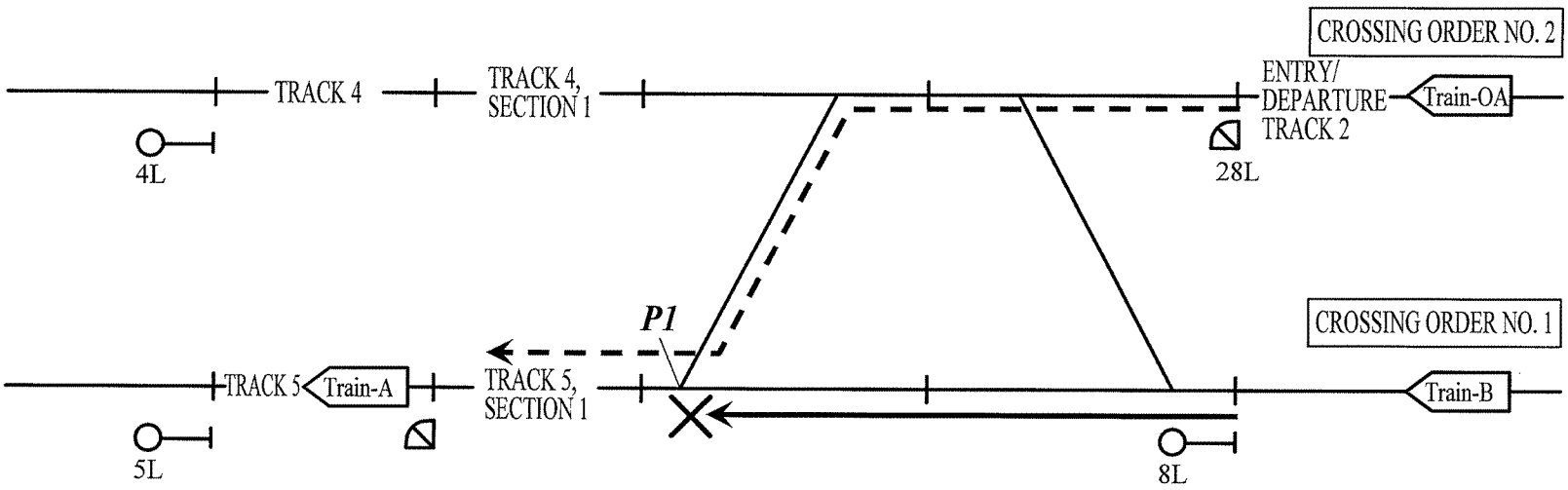
FIG. 4 is an illustration to explain an order determination function 1.

Details of the order determination function 1 are described with reference to FIG. 4. More specifically, description is made about a case where although the order of passing through a point P1 and arriving at a place of a track 5 of E station had been scheduled to be "No. 1: second train (Train-B)", "No. 2: first train (Train-A)" and "No. 3: third train (Train-OA)", the second train (Train-B) was late or the like, so that the first train (Train-A) has passed through the first point P1 and arrived at the track 5 before the second train (Train-B), and the first train (Train-A) and the third train (Train-OA) are going to connect to one another at the track 5.

In the present case, because the first train (Train-A) has passed through the point P1 and arrived at the track 5 before the second train (Train-B), the second train (Train-B) cannot enter the track 5 until the first train (Train-A) and the third train (Train-OA) connect to one another and depart from the track 5. That is, the second train (Train-B) cannot pass through the point P1 and enter the track 5 unless the third train (Train-OA) passes through the point P1 and arrives at the track 5 before the second train (Train-B), couples with the first train (Train-A) and departs from the track 5.

When the operation diagram is disrupted on account of train delay or the like, a dispatcher operates the train dispatcher console of the line central device to input train traffic rescheduling. At the time, in order to minimize dispatcher's input operation, the dispatcher only changes the main track operation diagram information and does not change the depot entry/departure operation diagram information.

Hence, in the present case, the dispatcher operates the train dispatcher console of the line central device (the line central device for the line including the E station) to only exchange the ranks of the second train (Train-B) and the first train (Train-A) among the ranks of the trains arriving at the track 5 of the E station.

Then, the interlocking device of the station device installed in the E station registers, in a register unit (e.g., RAM) included in the interlocking device, "No. 1: Train-A", "No. 2: Train-B" and "No. 3: Train-OA" as the order of using the point P1 ("P1 crossing order") based on the main track operation diagram information (actual operation diagram information) and the depot entry/departure operation diagram information from the line central device. Thereafter, the interlocking device registers "No. 1: Train-B" and "No. 2: Train-OA" in the register unit as the "P1 crossing order" when the connection 1st train (Train-A) passes through the point P1.

Further, the interlocking device can change, based on the on-track position information and so forth, the departure order, the crossing order and so forth registered in the register unit (see Step S63 in FIG. 3). For example, if the interlocking device registers "No. 1: Train-B" and "No. 2: Train-OA" as the "P1 crossing order" based on the main track operation diagram information (actual operation diagram information) and the depot entry/departure operation diagram information, and then determines, based on the on-track position information and so forth, for example, that the third train (Train-OA) is present in the station but the second train (Train-B) is not present in the station, the interlocking device changes the "P1 crossing order" registered in the register unit to "No. 1: Train-OA" and "No. 2: None". However, in the present case, as shown in FIG. 4, both the third train (Train-B) and the second train (Train-OA) are present in the station. Hence, the "P1 crossing order" registered in the register unit is not changed.

A conventional interlocking device performs route control for trains in accordance with the departure order, the crossing order and so forth registered in the register unit. Hence, for example, in the present case, taking the first train (Train-A) passing through the point P1 as a trigger, the conventional interlocking device registers "No. 1: Train-B" and "No. 2: Train-OA" as the "P1 crossing order (the order of using the point P1)", and in accordance with this "P1 crossing order", performs route control on the protection area of a signal 8L for the second train (Train-B) (control to configure a route for the second train (Train-B) to pass through the point P1 and enter the track 5, to be specific), and next, taking the second train (Train-B) passing through the point P1 as a trigger, registers "No. 1: Train-OA" as the "P1 crossing order", and in accordance with this "P1 crossing order", performs route control on the protection area of a signal 28L for the third train (Train-OA) (control to configure a route for the third train (Train-OA) to pass through the point P1 and enter the track 5, to be specific). However, this lets the second train (Train-B) arrive at the track 5 before the third train (Train-OA). Then, in order to permit the third train (Train-OA) to arrive at the track 5 before the second train (Train-B), the E station staff or the like needs to manually control the signals, the switches and so forth, or needs to operate the station device to change data. This is troublesome.

That is, in the case of the conventional interlocking device, if the order of using a predetermined point (in the present case, the point P1) registered in the register unit (e.g., RAM) is a first train, a second train and a third train, and the first, second and third trains pass through the predetermined point (P1) and proceed in the same direction (in the present case, toward the track 5), the device performs route control such that the third train passes through the predetermined point next to the second train in accordance with the order registered in the register unit, no matter whether a condition is satisfied, wherein the condition is that the third train is a train to connect to the first train.

Meanwhile, in the case of the interlocking device 31 of this embodiment, taking the first train passing through a predetermined point (in the present case, the point P1) as a trigger, the device 31 determines whether a condition is satisfied, wherein the condition is that the third train is a train to connect to the first train, and when determining that the condition is not satisfied, performs route control such that the third train passes through the predetermined point next to the third train in accordance with the order registered in the register unit, and when determining that the condition is satisfied, performs route control such that the third train passes through the predetermined point before the second train against the order registered in the register unit.

The interlocking device can distinguish connection trains from the other trains based on the main track operation diagram information (actual operation diagram information) and the depot entry/departure operation diagram information.

In the present case, the third train (Train-OA) is the train to connect to the first train (Train-A). Hence, the interlocking device 31 determines that the condition, which is that the third train is a train to connect to the first train, is satisfied, and performs route control such that the third train (Train-OA) passes through the point P1 before the second train (Train-B) against the order registered in the register unit. That is, route control on the protection area of the signal 28L for the third train (Train-OA) is prior to route control on the protection area of the signal 8L for the second train (Train-B). Therefore, first, the signal 28L is switched to the "proceed" side and also a switch installed in the protection area of the signal 28L is switched, whereby a route for the third train (Train-OA) to pass through the point P1 and enter the track 5 is configured, and when the third train (Train-OA) passes through the point P1, the signal 8L is switched to the "proceed" side and also a switch installed in the protection area of the signal 8L is switched, whereby a route for the second train (Train-B) to pass through the point P1 and enter the track 5 is configured. This automatically permits the third train (Train-OA) to arrive at the track 5 before the second train (Train-B). Hence, the E station staff or the like does not need to manually control the signals, the switches and so forth or does not need to operate the station device to change data. Thus, the above can eliminate the troublesomeness.

<Order Determination Function 2>

There has been a problem that, in not a few cases, at the time of operation diagram disruption, automatic route control for a shunting vehicle which is drawn out or installed is not performed because it does not rank No. 1 in the crossing order (entering/departing vehicles are out of the control target for automatic change in the crossing order). That is, because entering/departing vehicles are out of the control target for automatic change in the crossing order, if an entering/departing vehicle as a control target does not rank No. 1 in the crossing order, automatic control cannot be performed until the determination target train arrives at a platform and updates the train number. Here, the "drawn out" means that a vehicle is moved from a main track, such as a platform at a station, to another place (e.g., a storage track), whereas the "installed" means that a vehicle is moved in the opposite way.

Hence, in an embodiment, an order determination function 2 is provided which does not register an entering/departing vehicle in the crossing order under a certain condition. That is, the order determination function 2 is provided which deletes, under a certain condition, the registration of a shunting vehicle which enters and is drawn out, from the crossing order before the train number is updated.

Figure 5:
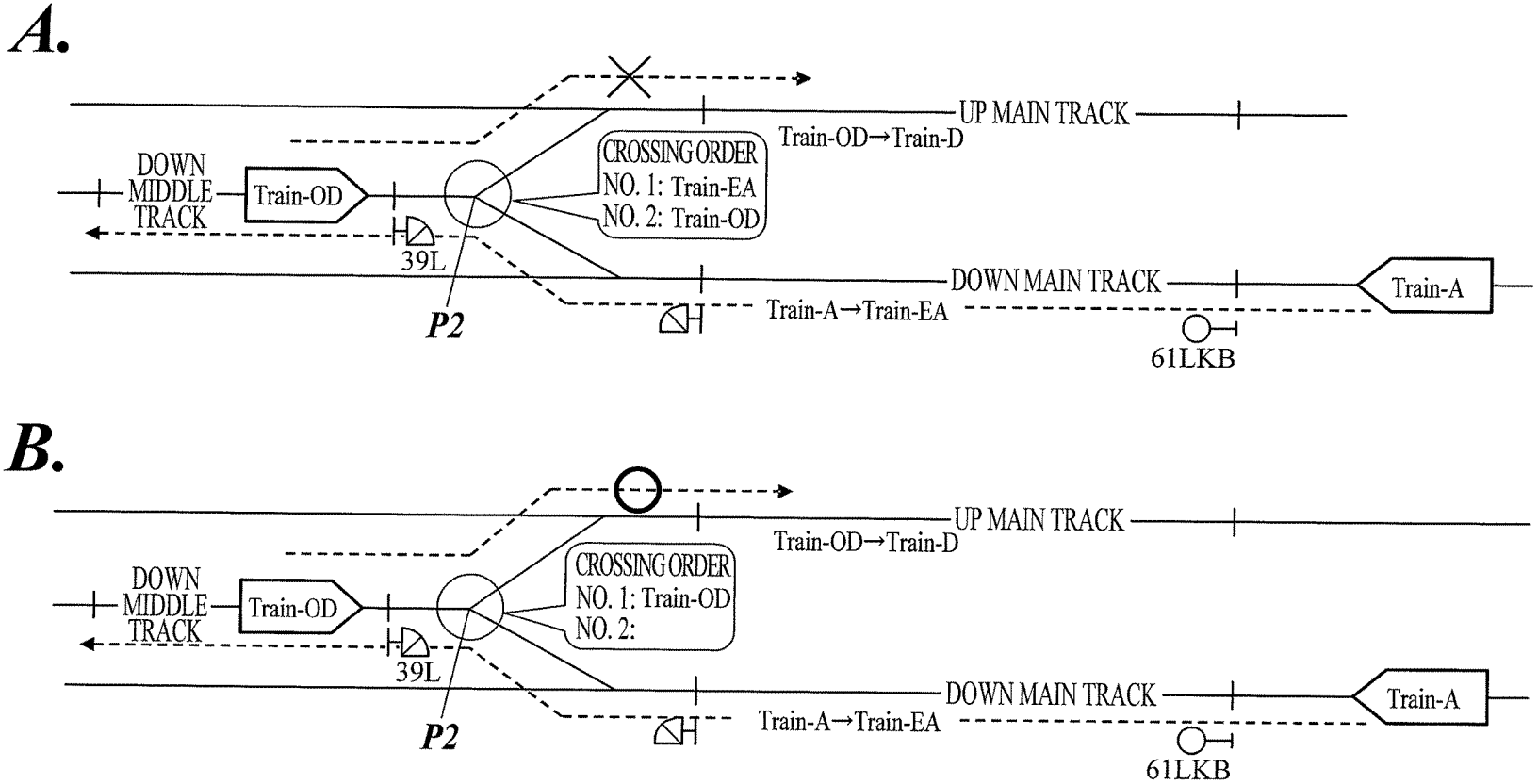
FIG. 5 is an illustration to explain an order determination function 2.

Details of the order determination function 2 are described with reference to FIG. 5. More specifically, description is made about a case where although the order of using a point P2 had been scheduled to be "No. 1: first train (Train-EA)" and "No. 2: second train (Train-OD), the first train was late or the like, so that the second train has arrived near the point P2 before the first train, and the first train is going to pass through the point P2 while proceeding to a vehicle depot from a main track, and the second train is going to pass through the point P2 while proceeding to a main track from a vehicle depot.

In the present case, the first train is a main track train (Train-A) which runs on a main track, and when the first train arrives at a platform, the train number thereof is updated from the "Train-A" to the "Train-EA", so that the first train becomes an entering vehicle (Train-EA) which enters a vehicle depot. The first train passes through the point P2 after the train number is updated from the "Train-A" to the "Train-EA". Further, the second train is a departing vehicle (Train-OD) which departs from a vehicle depot, and when the second train arrives at a platform, the train number thereof is updated from the "Train-OD" to the "Train-D", so that the second train becomes a main track train (Train-D).

Further, in the present case, the point P2 is formed of railway tracks crossing, the railway tracks on which trains (vehicles) moving in the station yard run. Hence, the order of using the point P2 ("P2 crossing order") is registered based on only the depot entry/departure operation diagram information of the operation diagram information.

As described above, in order to minimize dispatcher's input operation, the dispatcher only changes the main track operation diagram information and does not change the depot entry/departure operation diagram information.

Hence, in the present case, the interlocking device registers, in the register unit (e.g., RAM) included in the interlocking device, "No. 1: Train-EA" and "No. 2: Train-OD" as the "P2 crossing order" based on the depot entry/departure operation diagram information from the line central device. That is, the first train delay or the like is not reflected on the depot entry/departure operation diagram information, and hence "No. 1: Train-EA" and "No. 2: Train-OD" are registered as the "P2 crossing order".

Further, as described above, the interlocking device can change, based on the on-track position information and so forth, the order registered in the register unit. However, the conventional interlocking device cannot change the registered order unless the "entering/departing train number" is updated. For example, in the present case, because "No. 1: Train-EA" and "No. 2: Train-OD" are registered in the register unit as the "P2 crossing order", if the "Train-OD" is present in the last section of the route, the last section on which route control is to be performed for the "Train-EA", the conventional interlocking device can automatically change the "P2 crossing order" after the train number of the first train is updated from the "Train-A" to the "Train-EA", namely, can change the "P2 crossing order" if the current train number of the first train is the "Train-EA", but cannot change the "P2 crossing order" if the current train number of the first train is the "Train-A". Hence, even if the first train is late or the like, the conventional interlocking device cannot perform route control for the second train (Train-OD) until the first train arrives at a down platform, the train number thereof is updated from the "Train-A" to the "train-EA", and the "P2 crossing order" is changed. Accordingly, if the first train is late or the like, the second train (Train-OD) also arrives at an up platform late.

That is, in the case of the conventional interlocking device, if the order of using a predetermined point (in the present case, the point P2) registered in the register unit (e.g., RAM) is a first train and a second train, the first train passes through the point P2 while proceeding to a vehicle depot from a main track, and the second train passes through the point P2 while proceeding to a main track from a vehicle depot, the device performs route control such that the second train passes through the predetermine point (P2) next to the first train in accordance with the order registered in the register unit, although the second train is present on the route which the first train takes after passing through the predetermined point (P2) and control for the first train cannot be performed unless the second train leaves there.

Meanwhile, in the case of the interlocking device 31 of this embodiment, the device 31 can change the order registered in the register unit without the train number being updated from the "Train-A" to the "Train-EA".

More specifically, no matter whether the train number of the first train is already updated or not yet updated, the interlocking device 31 of this embodiment determines whether a condition is satisfied, wherein the condition is that the second train is present on the route which the first train takes after passing through a predetermined point (in the present case, the point P2), the route of the first train is a pre-specified route, and the second train is registered as No. 2 in the order of using the predetermined point (P2), and when determining that the condition is not satisfied, performs route control such that the second train passes through the predetermined point (P2) next to the first train in accordance with the order registered in the register unit, and when determining that the condition is satisfied, deletes the registration of the first train from the register unit and performs route control such that the second train passes through the predetermined point (P2) before the first train.

In the present case, although the train number of the first train is not updated to the "Train-EA" yet, because the second train (Train-OD) is present on the route which the first train (Train-A) takes after passing through the predetermined point (P2), the route 61LKB of the first train is a pre-specified route, and the second train (Train-OD) is registered as No. 2 in the "P2 crossing order", the interlocking device 31 determines that the condition is satisfied, and accordingly deletes the first train (Train-EA) from the crossing order registered in the register unit (e.g., RAM) and performs route control such that the second train (Train-OD) passes through the point P2 before the first train (Train-A). Thus, the first train is deleted from the crossing order even before the train number thereof is updated from the "Train-A" to the "Train-EA", so that the second train (Train-OD) ranks No. 1 in the crossing order in the state in which the first train is the "Train-A", and route control on the protection area of a signal 39L for the second train (Train-OD) can be performed. Therefore, in the state in which the first train is the "Train-A", the signal 39L is switched to the "proceed" side and also a switch installed in the protection area of the signal 39L is switched, whereby a route for the second train (Train-OD) to pass through the point P2 and enter the up platform is configured. Thus, the second train (Train-OD) can pass through the point P2 before the first train (Train-A), not only after the first train arrives at the down platform and the train number of the first train is updated from the "Train-A" to the "Train-EA", but also before this train number updating is performed. Therefore, the second train (Train-OD) does not arrive at the up platform late.

<Order Determination Function 3>

There has been a problem that a deadlock prevention function is incompatible with connection control, and hence although the deadlock prevention function is an essential function, the deadlock prevention function is removed in order to perform connection control.

Hence, in an embodiment, the deadlock prevention function is improved, and an order determination function 3 is provided which thereby allows automatic control if a train on a track is a connection partner train.

Here, the "deadlock prevention function" is a function which the interlocking device has, and this function can prevent a situation in which trains face one another or the like and are immovable. For example, there is a case where a second train is present on the route of a first train, and the second train is present in an area (hereinafter called the "deadlock area") where the first train and the second train face one another or the like and become immovable if route control for the first train is performed. In this case, if the deadlock prevention function of the interlocking device acts, the interlocking device does not perform route control for the first train, so that the first train stops, and accordingly the first train and the second train are not placed in the immovable situation. Meanwhile, if the deadlock prevention function of the interlocking device does not act, the interlocking device performs route control for the first train, so that the first train proceeds, and accordingly the first train and the second train are placed in the immovable situation.

Details of the order determination function 3 are described with reference to FIG. 6. More specifically, description is made about a case where a second train which is present in the deadlock area at the time of route control for a first train (Train-OA) is a train (Train-B) which is not a connection partner for the first train (Train-OA) (see FIG. 6(*a*)) and a case where the second train is a train (Train-A) which is a connection partner for the first train (Train OA) (see FIG. 6(*b*)).

In the case of the conventional interlocking device with the deadlock prevention function being ON, if a second train is present in the deadlock area at the time of route control for a first train, the deadlock prevention function acts until the second train moves out of the deadlock area. This, however, allows route control for the first train even if the second train present in the deadlock area is a connection partner for the first train. Thus, when the deadlock prevention function is ON, the first train and the second train cannot automatically connect to one another.

That is, in the case of the conventional interlocking device, when determining that a second train is present in a predetermined area (deadlock area) on the route of a first train before performing route control on a predetermined section for the first train, the device activates the deadlock prevention function until the second train moves out of the predetermined area (deadlock area), no matter whether a condition is satisfied, wherein the condition is that the second train is a train to connect to the first train. Hence, the conventional interlocking device performs route control on the predetermined section for the first train after performing route control for the second train whereby the second train moves out of the predetermined area (deadlock area).

Meanwhile, in the case of the interlocking device 31 of this embodiment, when determining that a second train is present in a predetermined area (deadlock area) on the route of a first train before performing route control on a predetermined section for the first train, the device 31 determines whether a condition is satisfied, wherein the condition is that the second train is a train to connect to the first train, and when determining that the condition is not satisfied, performs route control on the predetermined section for the first train after performing route control for the second train whereby the second train moves out of the predetermined area (deadlock area), and when determining that the condition is satisfied, performs route control on the predetermined section for the first train before performing route control for the second train.

Figure 6:
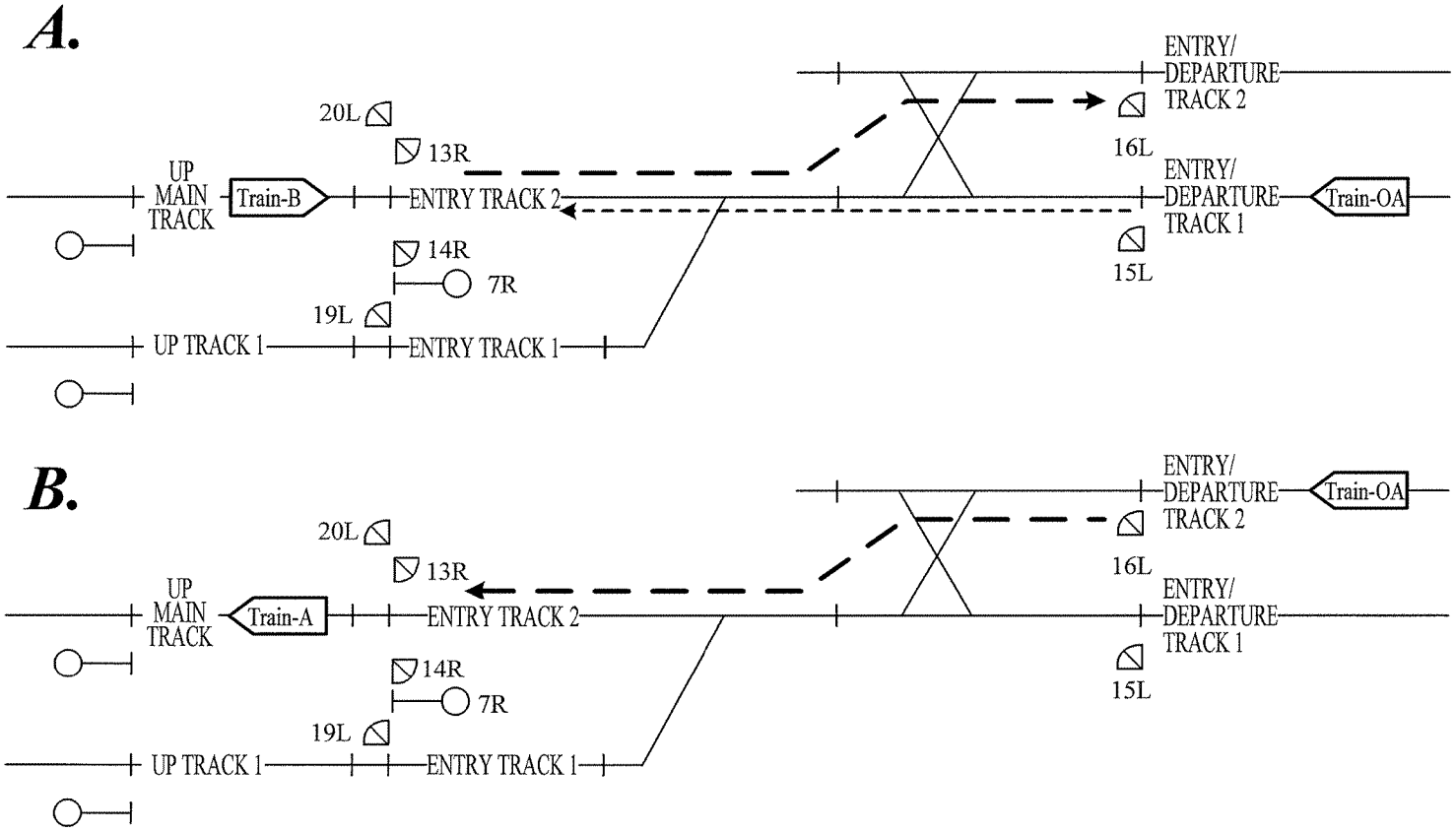
FIG. 6 is an illustration to explain an order determination function 3.

Of the cases of this embodiment, in the case shown in FIG. 6(*a*), because the second train is a train (Train-B) which is not a connection partner for the first train (Train-OA), the interlocking device 31 determines that the condition is not satisfied. Hence, the deadlock prevention function acts until the second train (another train (Train-B)) moves out of the deadlock area, and the device 31 performs route control on the predetermined section (the protection area of a shunting signal 15L) for the first train (Train-OA) after performing route control for the second train (Train-B) whereby the second train (Train-B) moves out of the deadlock area. Hence, the shunting signal 15L is not switched to the "proceed" side until the second train (Train-B) moves out of the deadlock area, and therefore the first train (Train-OA) stops in front of the shunting signal 15. Even in this case, the shunting signal 15L can be manually controlled (i.e., controlled to be switched to the "proceed" side). The same applies to a case where the first train (Train-OA) runs on an entry/departure track 2 (a draw-out track provided with a shunting signal 16L).

Meanwhile, of the cases of this embodiment, in the case shown in FIG. 6(*b*), because the second train is a train (Train-A) which is a connection partner for the first train (Train-OA), the interlocking device 31 determines that the condition is satisfied. Hence, the deadlock prevention function does not act, and the device 31 performs route control on the predetermined area (the protection area of the shunting signal 16L) for the first train (Train-OA) before performing route control for the second train (Train-A). Hence, even if the second train (Train-A) does not move out of the deadlock area, the shunting signal 16L is switched to the "proceed" side and also a switch installed in the protection area of the shunting signal 16L is switched, whereby a route for the first train (Train-OA) to pass through the shunting signal 16L and go to an up main track is configured. Hence, the first train (Train-OA) and the second train (Train-A) connect to one another. The same applies to a case where the first train (Train-OA) runs on an entry/departure track 1 (a draw-out track provided with the shunting signal 15L).

Thus, even if the deadlock prevention function is ON, the deadlock prevention function acts only when needed. Therefore, the deadlock prevention function can be effectively used.

<Order Determination Function 4>

Figure 7:
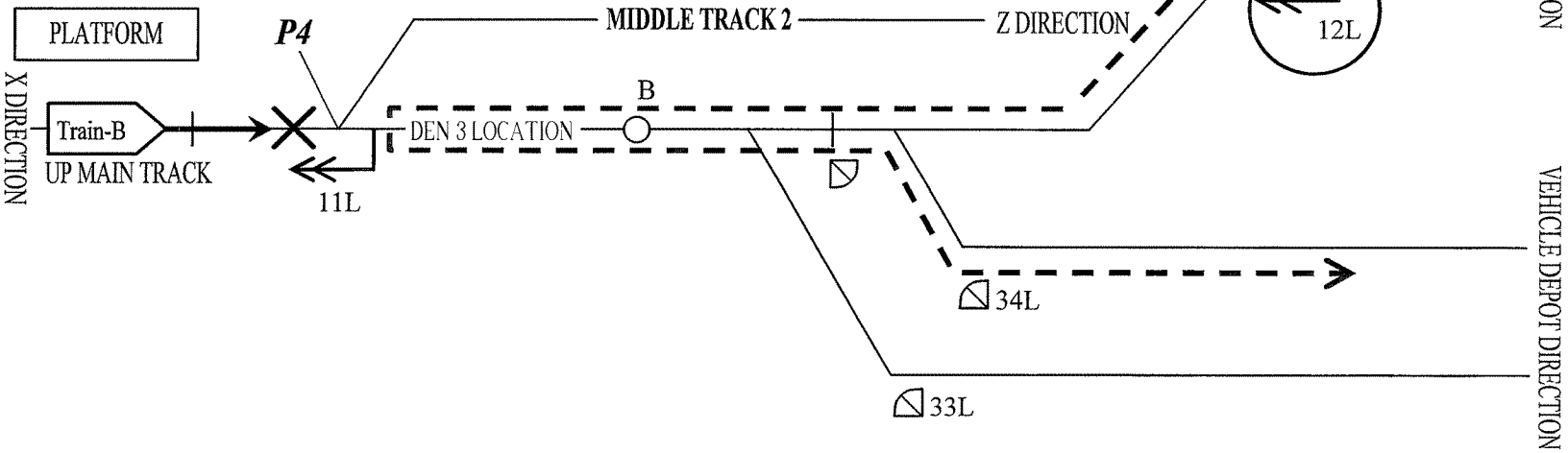
FIG. 7 is an illustration to explain an order determination function 4.

The conventional interlocking device has a problem that if an entering vehicle is present on an up main track, and there is a train which makes a turn on the way to the up main track and enters a vehicle depot without arriving at the up main track, the deadlock prevention function prevents the train from making a turn and entering the vehicle depot. For example, in a yard having a track layout as shown in FIG. 7, it is desired to set a route inside a signal 12L for a vehicle (Train-A) which arrives at a den 3 location as the last stop and enters a vehicle depot as indicated by a broken line. However, when another vehicle (Train-B) is present on an up main track, the deadlock prevention function prevents automatic route control on the protection area of the signal 12L, and hence the vehicle (Train-A) cannot enter the vehicle depot.

Hence, in an embodiment, an order determination function 4 is provided which allows automatic control on a first home route (an up first home signal 12L) without determining whether a train is present on the up main track, only for an electric car which arrives at the den 3 location, which is the arrival point of the first home route (the up first home signal 12L), as the last stop. That is, the order determination function 4 is provided which allows automatic route control on the signal 12L without activating a deadlock check although a train is present on the up main track, only for a train which arrives at the den 3 location and thereafter enters a vehicle depot.

Details of the order determination function 4 are described with reference to FIG. 7. More specifically, description is made about a case where at the time of route control on the up first home signal 12L for a first train (Train-A), a second train (Train-B) is present at an up main track platform, and the first train (Train-A) makes a turn in (at den 3 location) the protection area of the up first home signal 12L and enters a vehicle depot.

When a train is present at the up main track platform, in order to prevent a deadlock, route control on the up first home signal is not performed, usually. That is, a train present at the up main track platform (in the present case, the second train (Train-B)) is regarded as being present in the deadlock area.

As described above, in the case of the conventional interlocking device with the deadlock prevention function being ON, if a second train is present in the deadlock area at the time of route control on a section for a first train, the section which the first train is going to enter (hereinafter called an "entry section"), the deadlock prevention function acts until the second train moves out of the deadlock area.

Hence, when a second train is present in the deadlock area, manual control on the signal 12L for a first train (Train-A) is needed.

That is, in the case of the conventional interlocking device, when determining that a second train is present in a predetermined area (deadlock area) on a route of a first train before performing route control on a predetermined section (entry section) for the first train, the device activates the deadlock prevention function until the second train moves out of the predetermined area (deadlock area), no matter whether a condition is satisfied, wherein the condition is that the first train is a train which makes a turn in the predetermined section and moves out of the predetermined section. Hence, the conventional interlocking device performs route control on the predetermined section for the first train after performing route control for the second train whereby the second train moves out of the predetermined area (deadlock area).

However, the train which enters the entry section is not always a train which moves to the end point (arrival point) of the entry section and may be a train which makes a turn in the entry section and moves out of the entry section. If the first train is the train which makes a turn in the entry section and moves out of the entry section, route control on the entry section for the first train does not place the first train and the second train, which is present in the deadlock area, in the immovable state. Hence, if the first train is the train which makes a turn in the entry section and moves out of the entry section, it is unnecessary to activate the deadlock prevention function even if the second train is present in the deadlock area.

Meanwhile, in the case of the interlocking device 31 of this embodiment, when determining that a second train is present in a predetermined area (deadlock area) on a route of a first train before performing route control on a predetermined section for the first train, the device 31 determines whether a condition is satisfied, wherein the condition is that the second train is a train which makes a turn in a predetermined section (entry section) and moves out of the predetermined section, and when determining that the condition is not satisfied, performs route control on the predetermined section (entry section) for the first train after performing route control for the second train whereby the second train moves out of the predetermined area (deadlock area), and when determining that the condition is satisfied, performs route control on the predetermined section (entry section) for the first train before performing route control for the second train.

In the present case, because the first train is a train (Train-A) which makes a turn in the entry section and moves out of the entry section, the interlocking device 31 determines that the condition is satisfied. Hence, the deadlock prevention function does not act, and the device 31 performs route control on the entry section (protection area of the signal 12L) for the first train (Train-A) before performing route control for the second train (Train-B). That is, route control on the entry section for the first train (Train-A) is prior to route control for the second train (Train-B). Therefore, first, a route for the first train (Train-A) to make a turn in (at den 3 location) the entry section and move out of the entry section is configured, and then a route for the second train (Train-B) is configured. Thus, after the first train (Train-A) enters the vehicle depot, route control for the second train (Train-B) is performed. Therefore, manual control on the signal 12L for the first train (Train-A) is not needed. Note that the second train (Train-B) may be a train which makes a turn at a point P4 and goes in the Z direction or may be a train which enters the vehicle depot.

Thus, even if the deadlock prevention function is ON, the deadlock prevention function acts only when needed. Therefore, the deadlock prevention function can be effectively used.

<Order Determination Function 5>

In an ATC (Automatic Train Control) section, if catch-up control is performed, an overrun section is occupied, which affects control for a leading train. That is, in the ATC section, if catch-up control is performed on a route having an overrun section, the route of the leading train becomes incontrollable, which causes a deadlock.

Here, the "catch-up control" is control characteristic of ATC and is control to permit the following train to enter an entry section even if the leading train is present in the entry section, as long as a first track circuit of the entry section does not detect train presence (hereinafter simply called "energized"). In the entry section (the protection area in the route), a plurality of track circuits, from the first track circuit to the last track circuit, are laid. The "first track circuit" is a track circuit laid closest to the entrance of the entry section.

Figure 8:
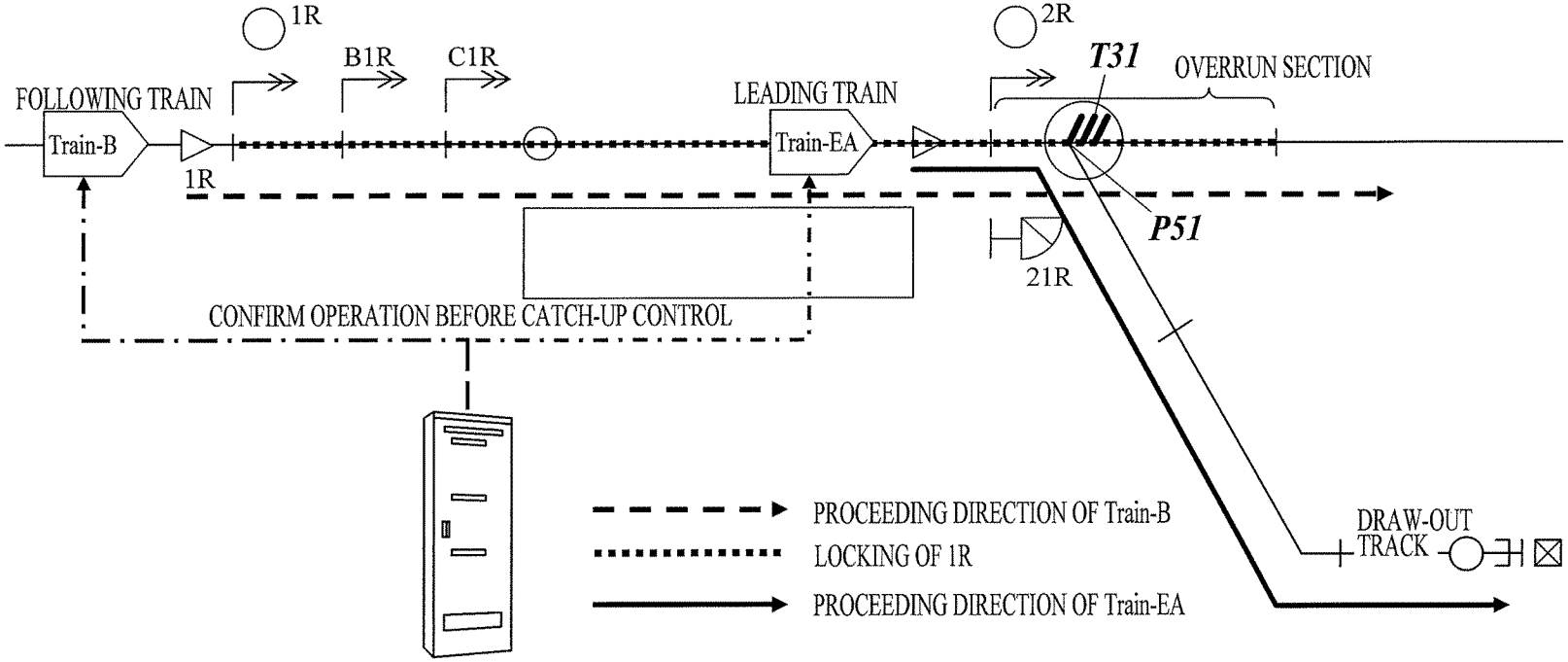
FIG. 8 is an illustration to explain an order determination function 5.

More specifically, for example, in the case where the leading train changes the driving direction when arriving at a place because of the operation, such as entering, if catch-up control on the following train is performed, a deadlock may occur. That is, for example, in an ACT section having a track layout as shown in FIG. 8, if the leading train is a train (Train-EA) which enters a vehicle depot from a main track, and catch-up control on the following train (Train-B) is performed on a route having an overrun section of the main track, the shunting route (the protection area of the shunting signal 21R) of the Train-EA becomes incontrollable.

Hence, in an embodiment, an order determination function 5 is provided which performs route control, taking into account the type and the proceeding direction of the leading train with a catch-up control function. That is, the order determination function 5 is provided which confirms the operation information and the proceeding direction of the leading train, and performs catch-up control only when possible. More specifically, the order determination function 5 is provided which, for example, deactivates catch-up control when needed by checking operation of the leading train and the following train at the time of catch-up control. That is, the order determination function 5 is provided which performs catch-up control when, in the route constituted of divisional routes of respective finer sections used in the ATC section, the determination result of the checking process to determine whether catch-up control can be performed is "control is possible", the first protection area track circuit of the route does not detect train presence, and cancellation of the track circuit booking by other train(s) is confirmed.

Details of the order determination function 5 are described with reference to FIG. 8 and FIG. 9. More specifically, description is made about a case where a second train is present between a first train (Train-B) and a switch T31, and the second train is an entering vehicle (Train-EA) (see FIG. 8), and a case where a second train is present between a second train (Train-B) and a switch T32, and the second train is a main track train (Train-A) (see FIG. 9).

In the case of the conventional interlocking device, taking into account that a first train (Train-B) overruns across a switch, the device performs route control on an overrun section (the section containing the switch T31 in the case shown in FIG. 8, and the section containing the switch T32 in the case shown in FIG. 9) in addition to an entry section (the protection area of the signal 1R in the case shown in FIG. 8, and the protection area of the signal 2L in the case shown in FIG. 9) at the time of route control on the entry section for the following train (Train-B).

Hence, in the case shown in FIG. 8, when route control on the entry section for the first train (Train-B) is performed, not only a route in the entry section but also a route in the overrun section is configured, so that not only the signal 1R is switched to the "proceed" side and locked thereon, but also the switch T31 is locked on the "normal" side (the side with oblique lines in FIG. 8, i.e., the main track side) and the shunting signal 21R is locked on the "stop" side. Therefore, the first train (Train-B) can run along the proceeding direction as scheduled even if it overruns the switch T31.

Figure 9:
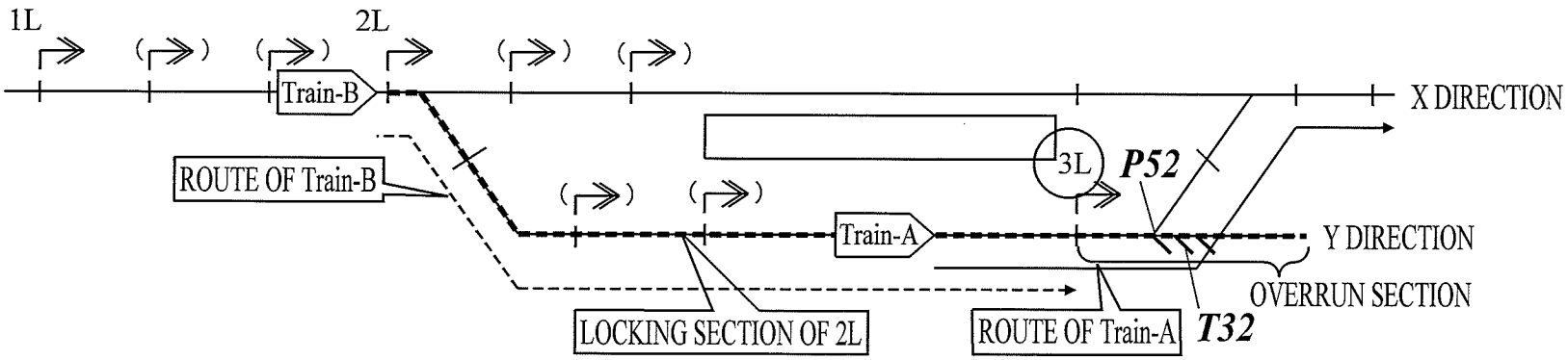
FIG. 9 is an illustration to explain the order determination function 5.

Further, in the case shown in FIG. 9, when route control on the entry section for the first train (Train-B) is performed, not only a route in the entry section but also a route in the overrun section is configured, so that the switch T32 is locked on the "normal" side (the side with oblique lines in FIG. 9, i.e., the Y direction side). Therefore, the first train (Train-B) can run along the proceeding direction as scheduled even if it overruns the switch T32.

There has been a problem that if, together with catch-up control on a first train as the following train, route control for the first train is performed by the below-described route control function 1, a second train as the leading train cannot run as scheduled.

More specifically, in the case shown in FIG. 8, if route control is performed together with catch-up control, at the time the second train (Train-EA) passes through the switch T31, a route for the first train (Train-B) is configured (the switch T31 is locked on the normal side and the shunting signal 21R is locked on the "stop" side, to be specific). Hence, although the second train (Train-EA) is an entering train which enters a vehicle depot, the second train cannot enter the vehicle depot.

Further, in the case shown in FIG. 9, if route control is performed together with catch-up control, at the time the second train (Train-A) passes through the switch T32, a route for the first train (Train-B) is configured (the switch T32 is locked on the normal side, to be specific). Hence, although the second train (Train-A) is a train which goes in the X direction, the second train cannot go in the X direction.

That is, in the case where the conventional interlocking device performs, together with catch-up control on a first train as the following train, route control on a predetermined section (the entry section+the overrun section) for the first train using the route control function 1, when determining that a second train is present between the first train and a predetermined point (in each present case, a point P51 or P52 where the switch T31 or T32 is installed) in the predetermined section before performing route control on the predetermined section for the first train, the device performs route control on the predetermined section for the first train before the second train passes through the predetermined point (P51 or P52), no matter whether a condition is satisfied, wherein the condition is that the route of the first train and the route of the second train diverge at the predetermined point (P51 or P52).

Meanwhile, in the case where the interlocking device 31 of this embodiment performs, together with catch-up control on a first train as the following train, route control on a predetermined section (the entry section+the overrun section) for the first train using the route control function 1, the device 31 confirms operation information (train type, etc.) and the proceeding direction of a second train (leading train) and determines whether a condition is satisfied, wherein the condition is that the route of the first train and the route of the second train diverge at a predetermined point (in each present case, the point P51 or P52 where the switch T31 or T32 is installed), and when determining that the condition is not satisfied, performs route control on the predetermined section (the entry section+the overrun section) for the first train in parallel with route control for the second train, and when determining that the condition is satisfied, performs route control on the predetermined section for the first train after performing route control for the second train whereby the second train passes through the predetermined point (P51 or P52).

Of the cases of this embodiment, in the case shown in FIG. 8, because the route of the first train (Train-B) and the route of the second train (Train-EA) diverge at the point P51, the interlocking device 31 determines that the condition is satisfied. Hence, after performing route control for the second train (Train-EA) whereby the second train passes through the point P51, the device 31 performs route control on the predetermined section (the entry section+the overrun section) for the first train (Train-B).

Further, of the cases of this embodiment, in the case shown in FIG. 9, because the route of the first train (Train-B) and the route of the second train (Train-A) diverge at the point P52, the interlocking device 31 determines that the condition is satisfied. Hence, after performing route control for the second train (Train-A) whereby the second train passes through the point P52, the device 31 performs route control on the predetermined section (the entry section+the overrun section) for the first train (Train-B).

Thus, even if the route control function 1 is ON, the route control function 1 acts only when needed. Therefore, the route control function 1 can be effectively used.

<Order Determination Function 6>

There has been a problem that, in some cases, although shunting signal control controls shunting signals at once, without a break to the last route, if a vehicle ranks No. 1 in all the crossing orders according to the depot entry/departure operation diagram, this unbroken control to the last route interferes with operation of a main track train.

Hence, in an embodiment, an order determination function 6 is provided which can put automatic control on hold in (i.e., somewhere along) a group of routes indicated by the depot entry/departure operation diagram, and can control the remaining routes after a condition, such as time or elapse of the holding time, is satisfied. That is, the order determination function 6 is provided which, if there is through time(s), registers the crossing order for each through time, and can put route control on hold in the depot entry/departure operation diagram, and can automatically control the remaining route(s) after the next route control condition is satisfied.

Figure 10:
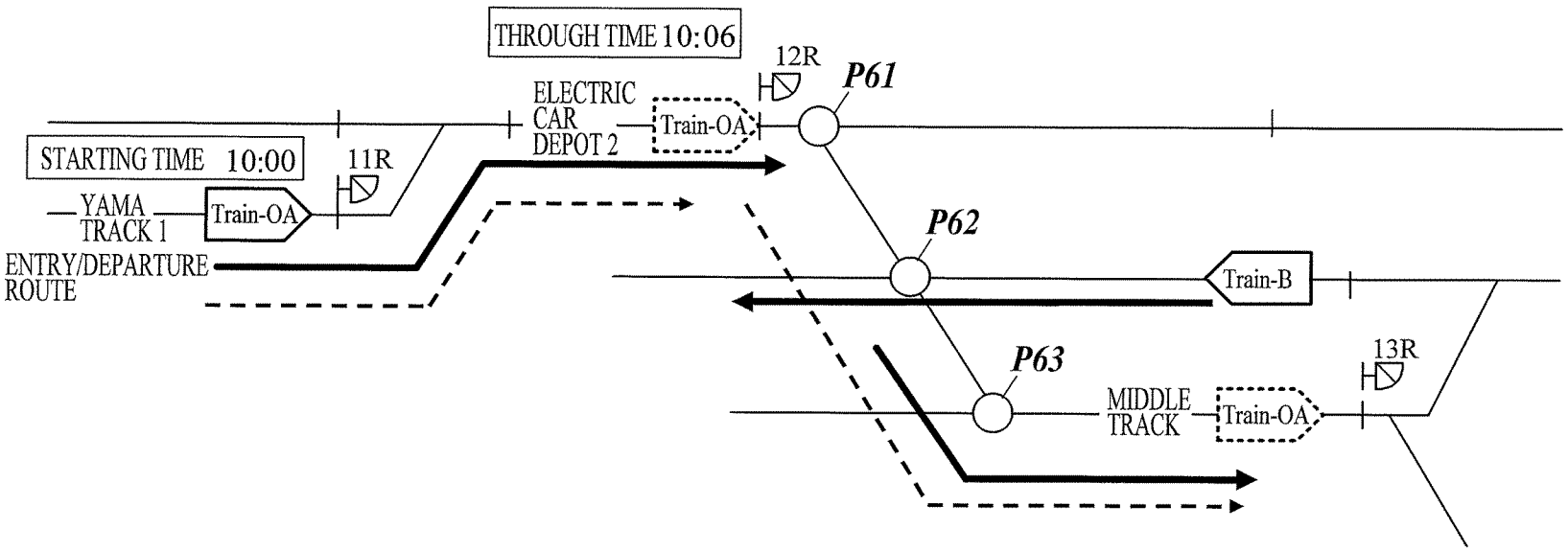
FIG. 10 is an illustration to explain an order determination function 6.

Details of the order determination function 6 are described with reference to FIG. 10. More specifically, description is made about a case where there are a shunting signal 11R installed at the start point of the route (departure route) of a first train (Train-OA) as a departing vehicle, a shunting signal 13R installed at the end point thereof and a shunting signal 12R installed between the shunting signals 11R and 13R, there are three points P61, P62 and P63 between the shunting signals 12R and 13R, and the route of the first train (Train-OA) and the route of a second train (Train-B) cross at the point P62.

The depot entry/departure operation diagram information contains starting time (time at which an entering/departing vehicle leaves the start point of an entry/departure route (an entry route in the case of an entering vehicle and a departure route in the case of a departing vehicle)) and may also contain though time at which the vehicle passes through a shunting signal or a point if there is a shunting signal or a point in the entry/departure route. However, the conventional interlocking device performs route control for an entering/departing vehicle by using only the starting time contained in the depot entry/departure operation diagram information. That is, when a departing vehicle arrives in front of the start point (in the present case, the shunting signal 11R) of the departure route, the device performs route control on the section(s) from the start point to the end point of the departure route based on the starting time at once.

Hence, like the present case, if starting time (time to pass through the shunting signal 11R) of a first train (Train-OA) is "10:00", and time to pass through the shunting signal 12R is "10:06", route control on the sections from the start point to the endpoint of the departure route for the first train (Train-OA) is performed at "10:00". Therefore, if a second train (Train-B) is late or the like, and time at which the second train (Train-B) arrives at the point P62 is later than the starting time of the first train (Train-OA) (e.g., "10:03"), the second train (Train-B) cannot pass through the point P62 until the first train (Train-OA) passes through the point P62. Hence, the second train (Train-B) is further late.

That is, in the case of the conventional interlocking device, the device controls a signal(s) and/or a switch(es) in the section(s) from the start point to the end point of an entry/departure route (an entry route if the control target train is an entering vehicle, and a departure route if the control target train is a departing vehicle) based on the starting time contained in the depot entry/departure operation diagram information, no matter whether a condition is satisfied, wherein the condition is that a through place(s) for which through time is set is provided in the entry/departure route.

Meanwhile, in the case of the interlocking device 31 of this embodiment, the device 31 determines whether a condition is satisfied, wherein the condition is that a through place(s) for which through time is set is provided in an entry/departure route (an entry route if the control target train is an entering vehicle, and a departure route if the control target train is a departing vehicle), and when determining that the condition is not satisfied, controls a signal(s) and/or a switch(es) in the section(s) from the start point to the end point of the entry/departure route based on the starting time contained in the depot entry/departure operation diagram information, and when determining that the condition is satisfied, controls a signal(s) and/or a switch(es) in the section(s) from the start point to the through place of the entry/departure route based on the starting time contained in the depot entry/departure operation diagram information, and controls a signal(s) and/or a switch(es) in the section(s) from the through place to another through place of the entry/departure route or in the section(s) from the through place to the end point of the entry/departure route based on the through time contained in the depot entry/departure operation diagram information.

Note that, for an entering vehicle, of the two end parts of an entry route, the end part on the main track side is the "start point (of the entry route)", and the end part on the vehicle depot side is the "end point (of the entry route)".

Further, for a departing vehicle, of the two end parts of a departure route, the end part on the vehicle depot side is the "start point (of the departure route)", and the end part on the main track side is the "end point (of the departure route)".

More specifically, in the present case, for example, when time to pass through the shunting signal 12R is contained in the depot entry/departure operation diagram information as the through time, the interlocking device 31 determines that the condition is satisfied, wherein the condition is that a through place(s) for which through time is set is provided in an entry/departure route. Then, first, when the first train (Train-OA) arrives in front of the shunting signal 11R and ranks No. 1 in all the crossing order(s) in the protection area of the shunting signal 11R (i.e., in the section(s) from the shunting signal 11R to the front of the shunting signal 12R), the device 31 performs route control on the protection area of the shunting signal 11R for the first train (Train-OA), and next, when the first train (Train-OA) arrives in front of the shunting signal 12R and ranks No. 1 in all the crossing orders (the orders of using the points P61, P62 and P63, for example), which are registered based on the through time, in the protection area of the shunting signal 12R (i.e., in the sections from the shunting signal 12R to the front of the shunting signal 13R), the device 31 performs route control on the protection area of the shunting signal 12R for the first train (Train-OA).

Therefore, in the present case, even if the second train (Train-B) is late or the like, and time at which the second train (Train-B) arrives at the point P62 becomes later than the starting time of the first train (Train-OA), the first train (Train-OA) does not rank No. 1 in the order of passing through the crossing point P62 until the second train (Train-B) passes through the point P62. Hence, the device 31 performs route control on the protection area of the shunting signal 12R for the first train (Train-OA) after the second train (Train-B) passes through the point P62. Therefore, the second train (Train-B) does not become late by waiting for the first train (Train-OA) to pass through the point P62.

Thus, quality of entry/departure control can be improved using the existing information (through time).

If, in addition to the time to pass through the shunting signal 12R, time to pass through the point P61, P62 or P63 is contained in the depot entry/departure operation diagram information as the through time, when, for example, the first train (Train-OA) arrives in front of the shunting signal 11R and ranks No. 1 in all the crossing order(s) in the section(s) from the shunting signal 11R to the front of the shunting signal 12R, the interlocking device 31 performs route control on the section(s) for the first train (Train-OA), and next, when the first train (Train-OA) arrives in front of the shunting signal 12R and ranks No. 1 in all the crossing orders, which are registered based on the through time, in the sections from the shunting signal 12R to the front of the point P61, P62 or P63, the device 31 performs route control on the section(s) for the first train (Train-OA).

<Order Determination Function 7>

There has been a problem that timing of route control is late between a main track and a freight track (on a freight passage track).

Hence, in an embodiment, in order to avoid an ordinary station's situation in which a train cannot even enter the protection area of the first starting signal because the first to the $n^{th}$ signals are not controlled until the train ranks No. 1 in the departure order, an order determination function 7 is provided which controls the first starting signal when a train ranks No. 1 or No. 2 in the departure order. That is, the order determination function 7 is provided which, at a station where simultaneous departure from a plurality of arrival/departure tracks in the same proceeding direction is available, controls starting signals for a train which ranks No. 2 in the departure order from the station a predetermined time period before its departure time, without waiting for the last starting signal for a train which ranks No. 1 in the departure order to be controlled.

Figure 11:
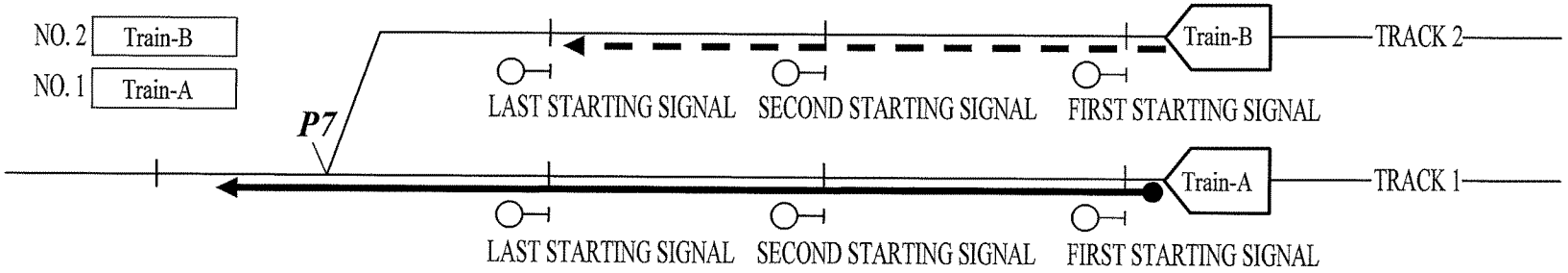
FIG. 11 is an illustration to explain an order determination function 7.

Details of the order determination function 7 are described with reference to FIG. 11. More specifically, description is made about a case where the order of departure (departure order) from F station is "No. 1: first train (Train-A)" and "No. 2: second train (Train-B)", the first train (Train-A) and the second train (Train-B) depart from different tracks, pass through the same point P7 and proceed in the same direction, the distance from the platform(s) (departure point(s)) to the point P7 is equal to or more than a predetermined threshold value, and there are a plurality of starting signals which indicate whether train departure is available both in the sections from the departure point of the first train (Train-A) to the point P7 and in the sections from the departure point of the second train (Train-B) to the point P7.

In the case of the conventional interlocking device, the device preferentially controls a plurality of starting signals which indicate whether departure is available for a train which ranks No. 1 in the departure order in accordance with the departure order registered in the register unit (e.g., RAM). Hence, if the departure order is registered as "No. 1: first train (Train-A)" and "No. 2: second train (Train-B)", a plurality of starting signals which indicate whether departure is available for the second train (Train-B) cannot be switched to the "proceed" side until the first train (Train-A) passes through its last starting signal among the starting signals and the second train (Train-B) ranks No. 1 in the departure order. That is, the second train (Train-B) cannot depart until the first train (Train-A) passes through its last starting signal.

Therefore, even if, in order to increase the number of departing trains per unit time, departure time of the first train (Train-A) and departure time of the second train (Train-B) are made to close to one another (i.e., the departure time of the second train (Train-B) is set to be before the time for the first train (Train-A) to pass through the last starting signal), the second train (Train-B) cannot depart as scheduled due to the control by the interlocking device. Further, the longer the distance from the departure point to the point P7 is, the longer the time period is, the time period which is from the time the first train (Train-A) departs (starts) to the time the first train passes through the last starting signal. Hence, the second train (Train-B) departs late.

That is, in the case of the conventional interlocking device, if the order of departure from a predetermined station, the order being registered in the register unit (e.g., RAM), is a first train and a second train, and the first train and the second train depart from different tracks, pass through the same point (in the present case, the point P7) and proceed in the same direction, the device controls a plurality of starting signals installed between the departure point of the second train and the point (P7) after the first train passes through the last starting signal among a plurality of starting signals installed between the denature point of the first train and the point (P7) in accordance with the order registered in the register unit, no matter whether a condition is satisfied, wherein the condition is that a plurality of starting signals are installed both between the departure point of the first train and a point and between the departure point of the second train and the point, and the routes of the first train and the second train are pre-specified routes.

Meanwhile, in the case of the interlocking device 31 of this embodiment, if the order registered in the register unit (e.g., RAM) is a first train and a second train, and the first train and the second train depart from different tracks, pass through the same point and proceed in the same direction, the device 31 determines whether a condition is satisfied, wherein the condition is that a plurality of starting signals are installed both between the departure point of the first train and a point (in the present case, the point P7) and between the departure point of the second train and the point (P7), and the routes of the first train and the second train are pre-specified routes, and when determining that the condition is not satisfied, controls, based on the order registered in the register unit, the plurality of starting signals installed between the departure point of the second train and the point (P7) after the first train passes through the last starting signal among the plurality of starting signals installed between the departure point of the first train and the point (P7), and when determining that the condition is satisfied, controls the plurality of starting signals installed between the departure point of the second train and the point (P7) based on the departure time of the second train without waiting for the first train to pass through the last starting signal among the plurality of starting signals installed between the departure point of the first train and the point (P7).

The interlocking device can also recognize the departure time from the station based on the main track operation diagram information (actual operation diagram information) and the depot entry/departure operation diagram information.

Thus, even before the first train (Train-A) passes through the last starting signal, the starting signals which indicate whether departure is available for the second train (Train-B) are switched to the "proceed" side so as to match the departure time (preset departure time) of the second train (Train-B). Hence, the second train (Train-B) can depart as scheduled.

<Route Control Function 1>

There has been a problem that route control is incompatible with catch-up control, which is characteristic of ATC.

Hence, in an embodiment, a route control function 1 is provided which performs route control for the following train when the first track circuit in the protection area of the route is energized due to the leading train.

Details of the route control function 1 are described with reference to FIG. 12.

Figure 12:
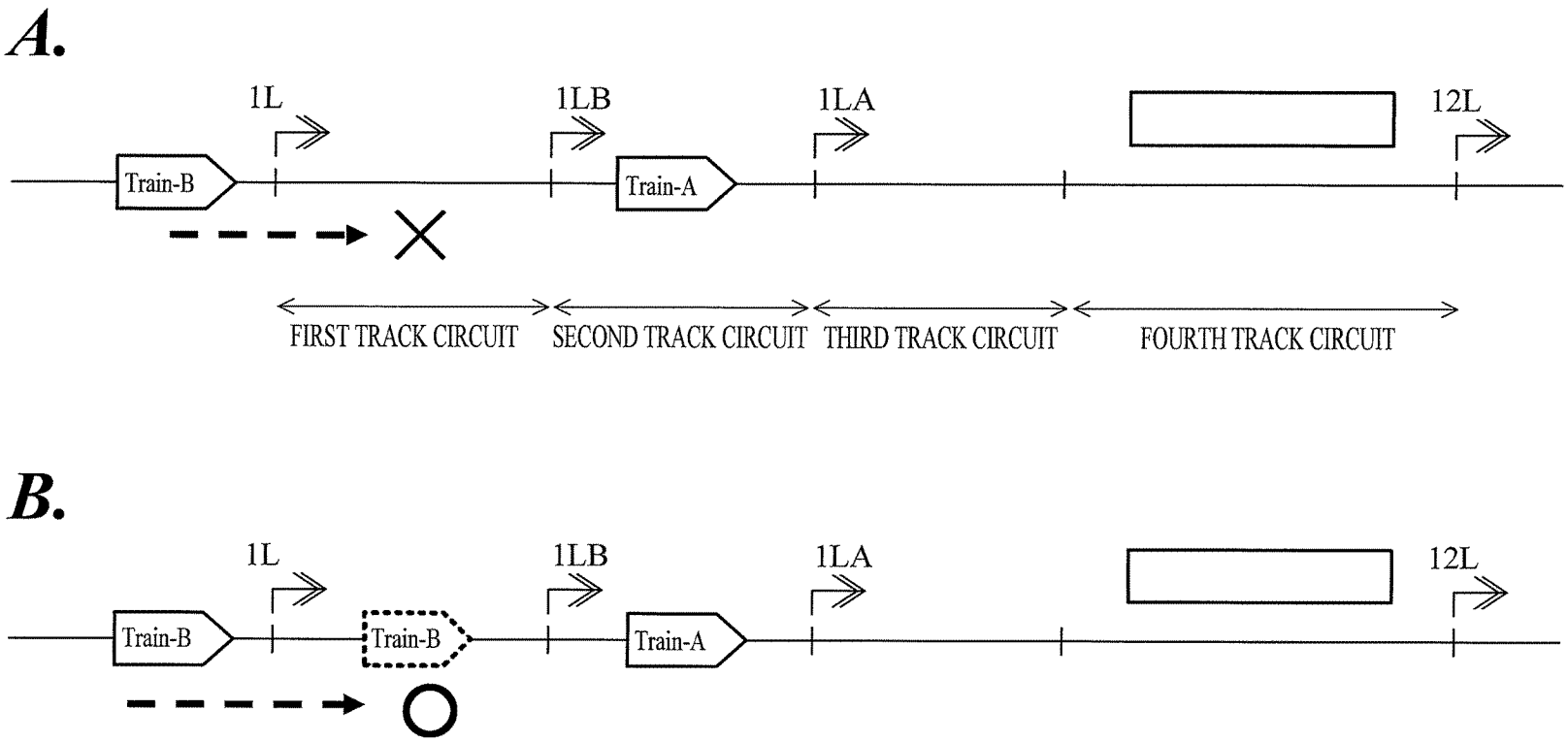
FIG. 12 is an illustration to explain a route control function 1.

As described above, in the ATC section (the section where a ground ATC device is installed), as shown in FIG. 12 as an example, even if a second train (Train-A) as the leading train is present in an entry section (the protection area of a signal 1L; to be specific, the sections from the signal 1L to the front of a signal 12L) which a first train (Train-B) as the following train is going to enter, catch-up control permits the first train (Train-B) to enter the entry section as long as the first track circuit in the entry section is energized.

However, in the case of the conventional interlocking device, as shown in FIG. 12(*a*), if the second train (Train-A) is present in the entry section which the first train (Train-B) is going to enter, the device does not perform route control on the entry section for the first train (Train-B) until the second train moves out of the entry section. Thus, route control is incompatible with catch-up control.

That is, in the case of the conventional interlocking device, when determining that a second train is present in a predetermined section (entry section) before performing route control on the predetermined section for a first train, the device does not perform route control on the predetermined section for the first train until the second train moves out of the predetermined section, no matter whether a condition is satisfied, wherein the condition is that, among a plurality of track circuits laid in the predetermined section, the first track circuit (the track circuit laid closest to the first train in the protection area of the set route) is energized.

Meanwhile, in the case of the interlocking device 31 of this embodiment, the device 31 performs route control for the following train together with catch-up control on the following train. That is, in the case of the interlocking device 31, when determining that a second train is present in a predetermined section (entry section) before performing route control on the predetermined section for a first train, the device 31 determines whether a condition is satisfied, wherein the condition is that, among a plurality of track circuits laid in the predetermined section, the first track circuit (the track circuit laid closest to the first train) is energized, and when determining that the condition is not satisfied, defers route control on the predetermined section for the first train until determining that the condition is satisfied, while keeping performing route control for the second train, and when determining that the condition is satisfied, performs route control on the predetermined section for the first train in parallel with route control for the second train.

For example, in the case shown in FIG. 12(*b*), although the second train (Train-A) is present in the entry section which the first train (Train-B) is going to enter, because the first track circuit among the plurality of track circuits laid in the entry section is energized, the interlocking device 31 determines that the condition is satisfied. Hence, the device 31 performs route control on the entry section for the first train (Train-B) in parallel with route control for the second train (Train-A).

<Route Control Function 2>

There has been a problem that, in some cases, in entry/departure control, timing of control on shunting signals is inappropriate. That is, although route control should be performed taking into account ATC switching at the time of departure (i.e., going), timing of control on shunting signals is controlled based on the starting time only, and therefore route control cannot be performed at appropriate timing.

Hence, in an embodiment, a route control function 2 is provided which can change the timing of control on shunting signals according to the characteristics of operation. That is, the route control function 2 is provided which specifies the timing of control on shunting signals with a station constant table, thereby setting the timing according to the operation. Here, the "station constant table" is data of all facilities, such as signals and switches, installed in the yard of each interlocking station, their types, their numbers (names) and so forth described in the form of a table, and used for train control and so forth.

Details of the route control function 2 are described with reference to FIG. 13.

As described above, the conventional interlocking device performs route control for an entering/departing vehicle using starting time contained in the depot entry/departure operation diagram information. Meanwhile, the interlocking device 31 of this embodiment performs, with the above-described order determination function 6, route control for an entering/departing vehicle using not only starting time but also through time contained in the depot entry/departure operation diagram information.

However, when route control for an entering/departing vehicle (control on shunting signals or the like, to be specific) is performed using starting time and through time contained in the depot entry/departure operation diagram information (i.e., scheduled time(s)), a specific shunting signal cannot be controlled at appropriate timing.

Examples of the specific shunting signal include a shunting signal installed in an ATC switching place on an entry/departure track (or a departure track or the like).

Because a ground ATC device is not installed in a vehicle depot, there is a case where a vehicle going to a main track is once stopped on the way thereto for ATC switching (switching to a state in which signals from the ground ATC device are receivable). The station where a departing vehicle is ATC-switched on the way to a main track is provided with an ATC switching place on an entry/departure track (or a departure track or the like) on which the departing vehicle going to the main track runs. The ATC switching place is where a shunting signal which indicates the departing vehicle to make a stop is installed.

Even if the actual starting time and/or through time of the departing vehicle are as scheduled (i.e., the same as those contained in the depot entry/departure operation diagram information), a problem arises when control on the shunting signal in the ATC switching place (control to switch to the "proceed" side) is performed using the time(s) contained in the depot entry/departure operation diagram information.

Figure 13:
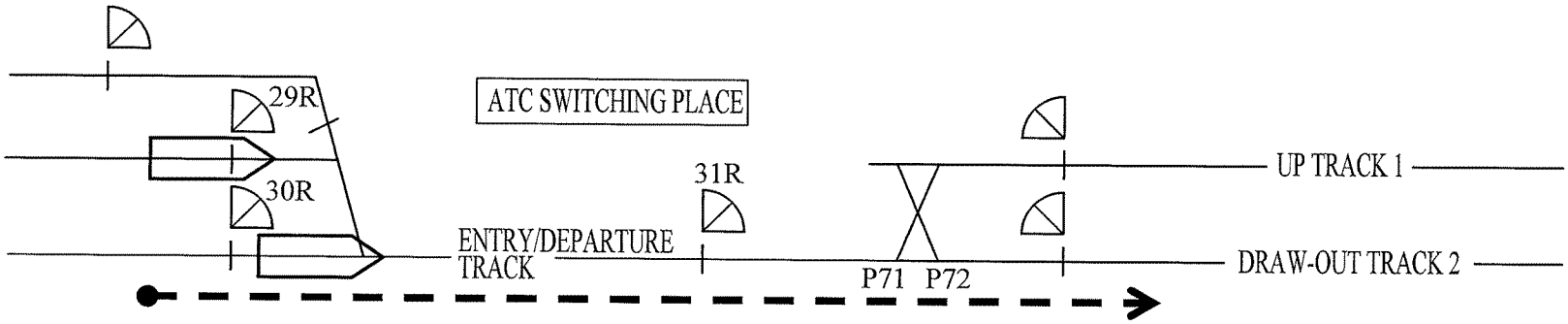
FIG. 13 is an illustration to explain a route control function 2.

For example, in the case shown in FIG. 13, if all the shunting signals (shunting signals 30R and 31R) in the protection area of the shunting signal 30R are controlled using the time(s) contained in the depot entry/departure operation diagram information, the shunting signal 31R at the ATC switching place is set to be switched to the "proceed" side at the timing of control on the shunting signal 30R.

More specifically, for example, let's suppose that the scheduled starting time from the shunting signal 30R is "10:00" and the scheduled arrival time in front of the shunting signal 31R is "10:03", but the actual starting time from the shunting signal 30R is "10:02", and the actual arrival time in front of the shunting signal 31R is "10:05", and the departing vehicle is required to make a stop in front of the shunting signal 31R for "one minute".

A route is not replaced until the control target train passes through. Hence, even if the actual time of the departing vehicle is later than the scheduled time thereof, the replacement (return to the "stop" side) is not performed until the departing vehicle passes through the shunting signal 30R. Therefore, even if the shunting signal 30R is switched to the "proceed" side at "10:00", the vehicle can pass through the shunting signal 30R at "10:02" without any problem. However, as to the shunting signal 31R at the ATC switching place, even if the scheduled arrival time in front of the shunting signal 31R is "10:03", if the vehicle ranks No. 1 in the crossing orders for the points P71 and P72, the shunting signal 31R is switched to the "proceed" side, no matter whether it is not "10:03" yet or it is already, and no matter whether "one minute" is set or not as a time period for which the departing vehicle stops in front of the shunting signal 31R. Therefore, when the departing vehicle arrives in front of the shunting signal 31R, the shunting signal 31R is already switched to the "proceed" side. Then, the departing vehicle passes through the shunting signal 31R without making a stop.

That is, in the case of the conventional interlocking device, if a plurality of shunting signals is installed on a departure route, which is the route of a train (departing vehicle) departing from a vehicle depot, the device controls the plurality of shunting signals installed on the departure route based on the depot entry/departure operation diagram information, no matter whether a condition is satisfied, wherein the condition is that the plurality of shunting signals include a specific shunting signal to make the departing vehicle make a stop.

Meanwhile, in the case of the interlocking device 31 of this embodiment, if a plurality of shunting signals is installed on a departure route, which is the route of a train (departing vehicle) departing from a vehicle depot, the device 31 determines whether a condition is satisfied, wherein the condition is that the plurality of shunting signals include a specific shunting signal (the shunting signal at the ATC switching place) to make the departing vehicle make a stop, and when determining that the condition is not satisfied, controls the plurality of shunting signals installed on the departure route based on the depot entry/departure operation diagram information, and when determining that the condition is satisfied, controls the specific shunting signal based on the on-track position information on the departing train and the entry state of the departing train into a predetermined track circuit (start-point track circuit), and controls the shunting signals except the specific shunting signal (the shunting signal at the ATC switching place) based on the depot entry/departure operation diagram information.

More specifically, the interlocking device 31 of this embodiment controls the shunting signals except the shunting signal at the ATC switching place based on the time(s) contained in the depot entry/departure operation diagram, and controls the shunting signal at the ATC switching place based on the on-track position information on the departing vehicle and the entry state of the departing vehicle into a predetermined track circuit (start-point track circuit).

As a system for controlling the shunting signal at the ATC switching place, there are a start-point track circuit housing system and a start-point track circuit entering system, and either one of them can be selected according to the operation (shape of railway tracks in an entry section, track circuit length, train length, etc.).

Here, the "start-point track circuit" is a track circuit which indicates the starting point when route control is performed.

In the start-point track circuit housing system, after a predetermined time elapses from the point of time that the adjacent track circuit adjacent to the start-point track circuit is switched from the drop state (state in which a vehicle is detected) to the energized state (state in which no vehicle is detected) (i.e., the point of time that a departing vehicle has entirely entered an entry section), a shunting signal at an ATC switching place is switched to the "proceed" side.

Meanwhile, in the start-point track circuit entering system, after a predetermined time elapses from the point of time that both the start-point track circuit and the adjacent track circuit adjacent to the start-point track circuit become the drop state (i.e., the point of time that the head part of a departing vehicle has entered an entry section), a shunting signal at an ATC switching place is switched to the "proceed" side.

The length of the "predetermined time" may be preset, or appropriately set by the interlocking device 31 based on the operation (shape of railway tracks in an entry section, track circuit length, train length, etc.) or the like.

<Train Tracking Function 1>

There has been a problem that, in the case where an interlocking device for main tracks and an interlocking device for vehicle depots are separate, because the system is constructed at a station, when viewed from a station, movement to a vehicle depot is regarded as entry, and movement from the vehicle depot is regarded as departure, but when viewed from a vehicle depot, it is opposite, namely, movement to a station is regarded as departure, and movement from the station is regarded as entry. That is, at a vehicle depot, a train which comes in is regarded as entering, and a train which goes out is regarded as departing. This is the opposite way of thinking to that, at a station, an entering train is regarded as departing, and a departing train is regarded as entering.

Hence, in an embodiment, a train tracking function 1 is provided which, in an interlocking device for vehicle depots, performs, inside its route-control-system device, the same process as that of the one for stations, but displays on the screen "O" as the number of a departing train and "E" as the number of an entering train, and also reverses the first sign of the number of the train, the departure of which is reported to the related station, by vehicle depot interlocking. That is, the train tracking function 1 is provided which, in an interlocking device for vehicle depots, performs, inside its route-control-system device, the same process as that of an interlocking device for stations, but displays train numbers on the screen by converting the first sign of the number of a departing train into "E" and converting the first sign of the number of an entering train into "O".

Details of the train tracking function 1 are described with reference to FIG. 14.

The interlocking device 31 (the route-control-system device of the interlocking device 31, to be specific) performs processes, regarding the fact that a train departs from (goes out) the target area as "Enter" and the fact that a train enters (comes in) the target area as "Depart".

In a large station, an interlocking device 31 for main tracks, which mainly handles main track(s) as the target area, and an interlocking device 31 for vehicle depots, which mainly handles a vehicle depot(s) as the target area, may be installed. In this case, as shown in FIG. 14(*a*), the interlocking device 31 for main tracks performs processes, regarding the fact that a train departs from the target area, namely, train movement of "main track→vehicle depot", as "Enter", and the fact that a train enters the target area, namely, train movement of "vehicle depot→main track", as "Depart". On the other hand, the interlocking device 31 for vehicle depots performs processes, regarding the fact that a train departs from the target area, namely, train movement of "vehicle depot→main track", as "Enter" and the fact that a train enters the target area, namely, train movement of "main track→vehicle depot", as "Depart".

Thus, the interlocking device 31 for main tracks and the interlocking device 31 for vehicle depots take "Enter" and "Depart" in the opposite way.

Hence, if each of these interlocking devices 31 displays the position of a train on a display unit (e.g., a display unit included in the interlocking device 31) in its way, the indication by the interlocking device 31 for main tracks and the indication by the interlocking device 31 for vehicle depots do not match and are difficult to understand. More specifically, for example, for a first train which goes to a vehicle depot from a main track, the interlocking device 31 for main tracks displays "Train-EA", whereas the interlocking device 31 for vehicle depots displays "Train-OA". This makes it difficult to grasp train movement and accordingly causes the station staff or the like to make a misjudgment or the like.

Figure 14:
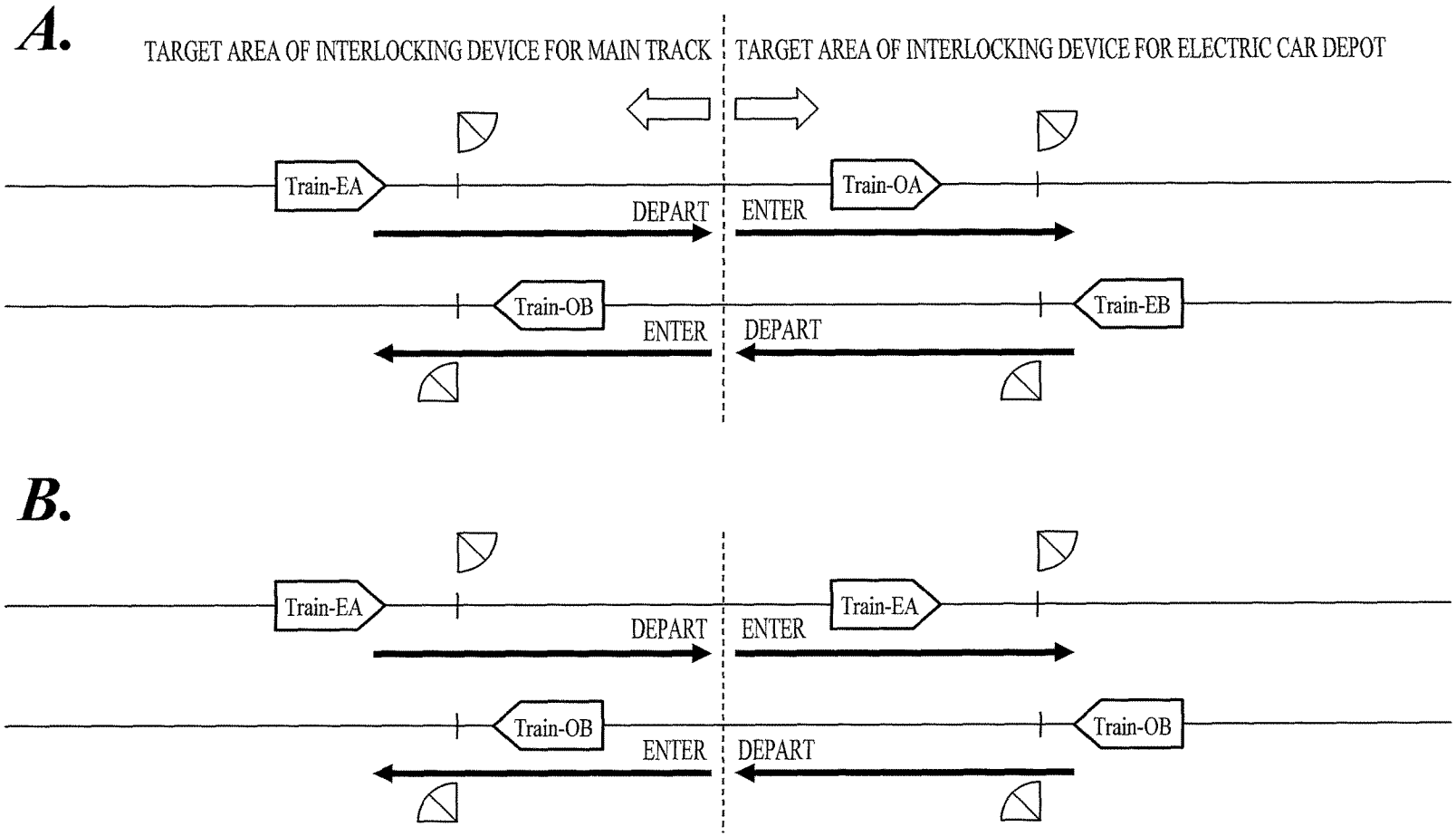
FIG. 14 is an illustration to explain a train tracking function 1.

Then, in this embodiment, the interlocking device 31 for vehicle depots treats, in processing, the fact that a train departs from the target area (i.e., train movement of "vehicle depot→main track") as "Enter" and the fact that a train enters the target area (i.e., train movement of "main track→vehicle depot") as "Depart" as usual as shown in FIG. 14(*a*), and treats, in displaying, the fact that a train departs from the target area (i.e., train movement of "vehicle depot→main track") as "Depart" and the fact that a train enters the target area (i.e., train movement of "main track→vehicle depot") as "Enter" as shown in FIG. 14(*b*). This allows the indication by the interlocking device 31 for main tracks and the indication by the interlocking device 31 for vehicle depots to match and therefore makes it easy to grasp train movement.

<Train Tracking Function 2>

There has been a problem that, at the time of shunting work at a vehicle depot, if a vehicle enters a draw-out track, because an entering vehicle and a departing vehicle are not distinguishable from one another, the entering vehicle is misrecognized as a departing vehicle, and the train number is shifted by error.

Hence, in an embodiment, a train tracking function 2 is provided which, at the time of work on the vehicle depot side, uses an "in-work switch" and displays, on accessory operation panels on both sides, indications clearly showing that shunting-in-yard is being performed, and also masks control point information (information for controlling signals), thereby preventing train numbers from being shifted by error. That is, the train tracking function 2 is provided which, at the time of shunting using a draw-out track at a vehicle depot, uses an "in-work switch" at the vehicle depot in advance, and cuts a vehicle depot departure report sending condition (a condition to be satisfied by an interlocking device of a station concerned to send, to the next station, information that a train is going to go to the next station in response to signal aspect) and the control point information, and also displays, on the accessory operation panels on both sides, the indications clearly showing that shunting-in-yard is being performed.

Details of the train tracking function 2 are described with reference to FIG. 15.

At a station where an interlocking device 31 for main tracks, which mainly handles a main track(s) as the target area, and an interlocking device 31 for vehicle depots, which mainly handles a vehicle depot(s) as the target area, are installed, there is a case where a train (vehicle) in the target area of the interlocking device 31 for vehicle depots temporarily enters the target area (draw-out track or the like) of the interlocking device 31 for main tracks, and returns to the target area of the interlocking device 31 for vehicle depots. The interlocking device 31 performs processes, regarding the fact that a train enters the target area as "Depart". Hence, in the above case, the interlocking device 31 for main tracks misrecognizes the train which temporarily enters there as a departing vehicle and shifts the train number.

Figure 15:
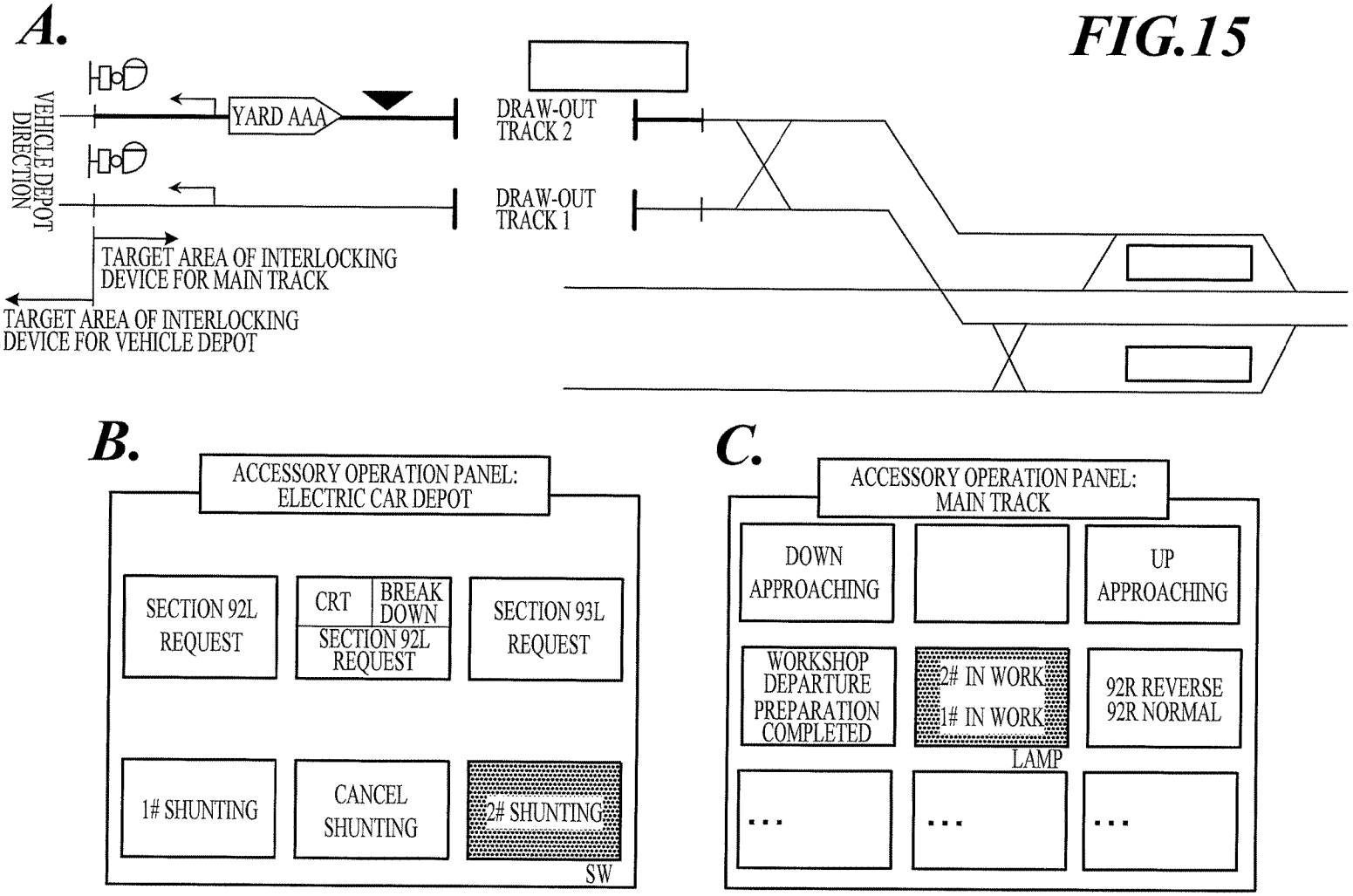
FIG. 15 is an illustration to explain a train tracking function 2.

Hence, in this embodiment, the accessory operation panel as shown in FIG. 15(*b*) is attached to the interlocking device 31 for vehicle depots, and the accessory operation panel as shown in FIG. 15(*c*) is attached to the interlocking device 31 for main tracks.

The accessory operation panel attached to the interlocking device 31 for vehicle depots is provided with the "in-work switch", such as a "1# shunting" switch and a "2# shunting" switch as shown in FIG. 15(*b*). This "in-work switch" is pressed by an operator who operates the interlocking device 31 for vehicle depots when shunting using a draw-out track or the like at a vehicle depot (shunting-in-yard) is performed. The "in-work switch" lights up when pressed. Hence, this lighting can notify that the shunting-in-yard is being performed. In addition, when the "in-work switch" is pressed, the interlocking device 31 for vehicle depots notifies this message to the interlocking device 31 for main tracks.

The accessory operation panel attached to the interlocking device 31 for main tracks is provided with an "in-work lamp", such as a "1# in work, 2# in work" lamp as shown in FIG. 15(*c*). This "in-work lamp" lights up when the "in-work switch" on the accessory operation panel attached to the interlocking device 31 for vehicle depots is pressed. Hence, this lighting can notify that the shunting-in-yard is being performed.

Further, when the "in-work switch" is pressed, the interlocking device 31 for vehicle depots masks (cuts) the departure report sending condition and the control point information, which are supposed to be sent to the interlocking device 31 for main tracks. Then, although the departure report sending condition and the control point information from the interlocking device 31 for vehicle depots are masked (cut), when determining that a train enters the target area, the interlocking device 31 for main tracks does not shift the train number of the departing train.

<Train Tracking Function 3>

There has been a problem that an up track between I station (exclusive) and G station cannot be controlled because it is out of the tracking area. That is, the I station is controlled by a system different from the train operation control system 1, and hence the up track between the I station (exclusive) and the G station cannot be controlled by the train operation control system 1 because it is out of its tracking area. Accordingly, there has been a problem that a passenger-guidance and departure-timing display device of H station (single-track and single-platform station), which is between the G station (interlocking station) and the I station, cannot be controlled.

Then, in an embodiment, in order to let the train operation control system 1 control both the up track and the down track between the I station (exclusive) and the G station and also in order to control the passenger guidance and the departure timing of the H station, a tracking device (a route-control-system device RCS and an interlocking-system device FX) for the I station is installed in an equipment room of the G station, and a train tracking function 3 is provided which lets the train operation control system 1 perform the control by sending/receiving information to/from the system which controls the I station. That is, a train tracking device (the station device 30 for the I station) is installed so as to track trains present on the way to the I station from the H station (H station→I station). The train tracking function 3 can also control the passenger-guidance and departure-timing display device by sending/receiving train number information to/from the system which controls the I station and by obtaining the actual time(s) of arrival at and departure from the I station and the H station.

Details of the train tracking function 3 are described with reference to FIG. 16.

More specifically, description is made about a case where through operation is available between a line adopting the train operation control system 1 (adopting line) and a line not adopting the train operation control system 1 (non-adopting line), the G station and the H station in the adopting line and the I station and the J station in the non-adopting line are arranged in the order of "(down side) G station→H station→I station→J station (up side)", the G station is the interlocking station provided with the station device 30, the H station is the single-track and single-platform station provided with no station device 30, and the up track between the I station and the G station except the I station (section(s) on the right of the broken line S-S') is out of the target area (tracking area) of the interlocking device 31 of the station device 30 installed in the G station.

Figure 16:
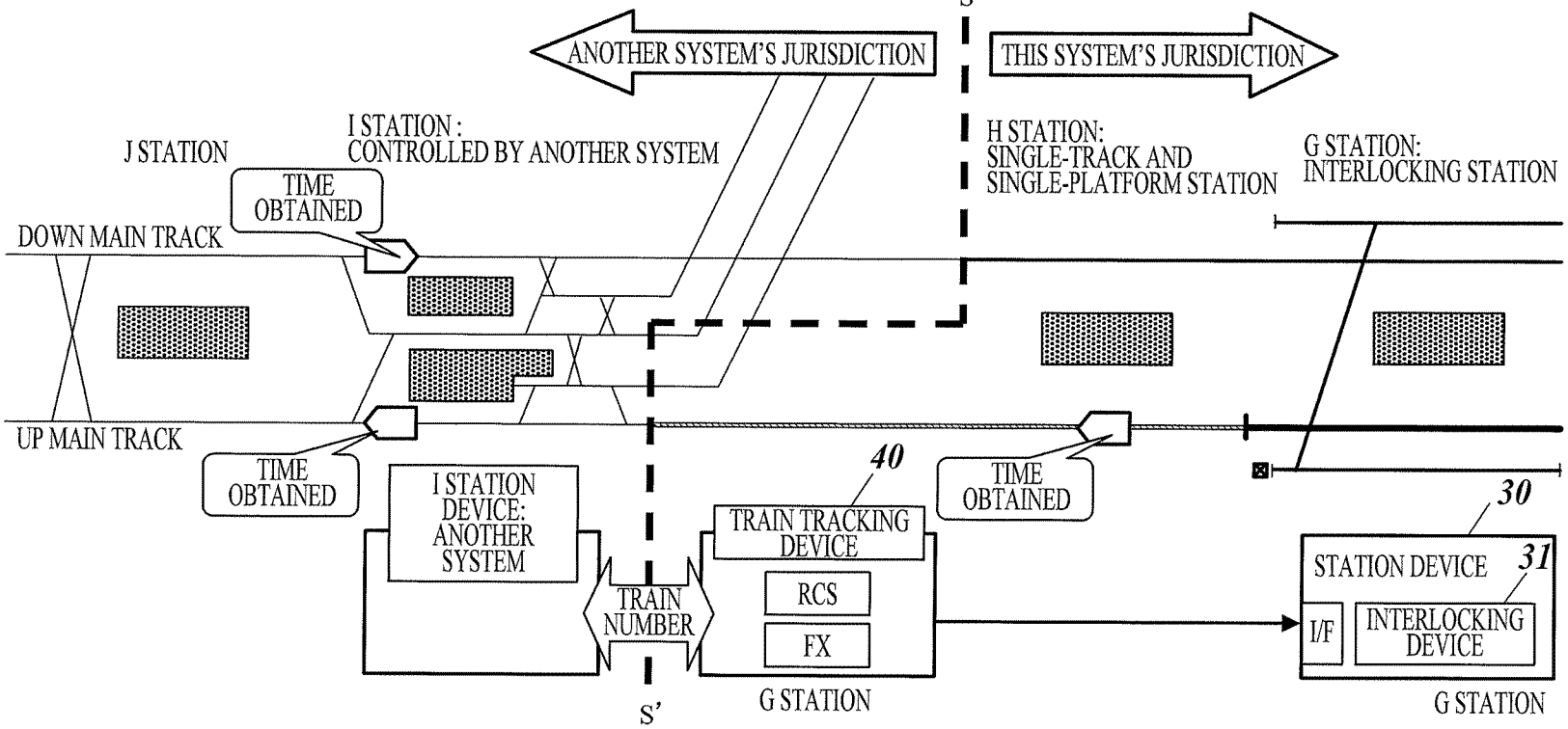
FIG. 16 is an illustration to explain a train tracking function 3.

In the section(s) having the track layout shown in FIG. 16, suppose that the I station is the interlocking station in the adopting line, the up track between the I station and the G station except the I station should be in the target area of the interlocking device 31 (the interlocking device 31 for the I station) of the station device 30 installed in the I station.

Hence, in this embodiment, the interlocking device 31 for the G station and a train tracking device (a device corresponding to the interlocking device 31 for the I station) 40 are installed in the G station. This train tracking device 40 is provided with an interface so that the interlocking device 31 can send/receive the train number information to/from the station device (station device of the system which controls the I station) installed in the I station, and also can track trains on the up track between the I station and the G station except the I station.

Thus, the train operation control system 1 can control both the up track and the down track between the I station and the G station except the I station, and also can control the passenger guidance and the departure timing of the H station (single-track and single-platform station).

<Train Tracking Function 4>

There has been a problem that train numbers need to be transmitted between a new type electronic interlocking device and an electronic interlocking device for vehicle depots.

Hence, in an embodiment, a train number sending/receiving device is improved, and a train tracking function 4 is provided which thereby can send/receive train number information to/from a route control support device.

Figure 17:
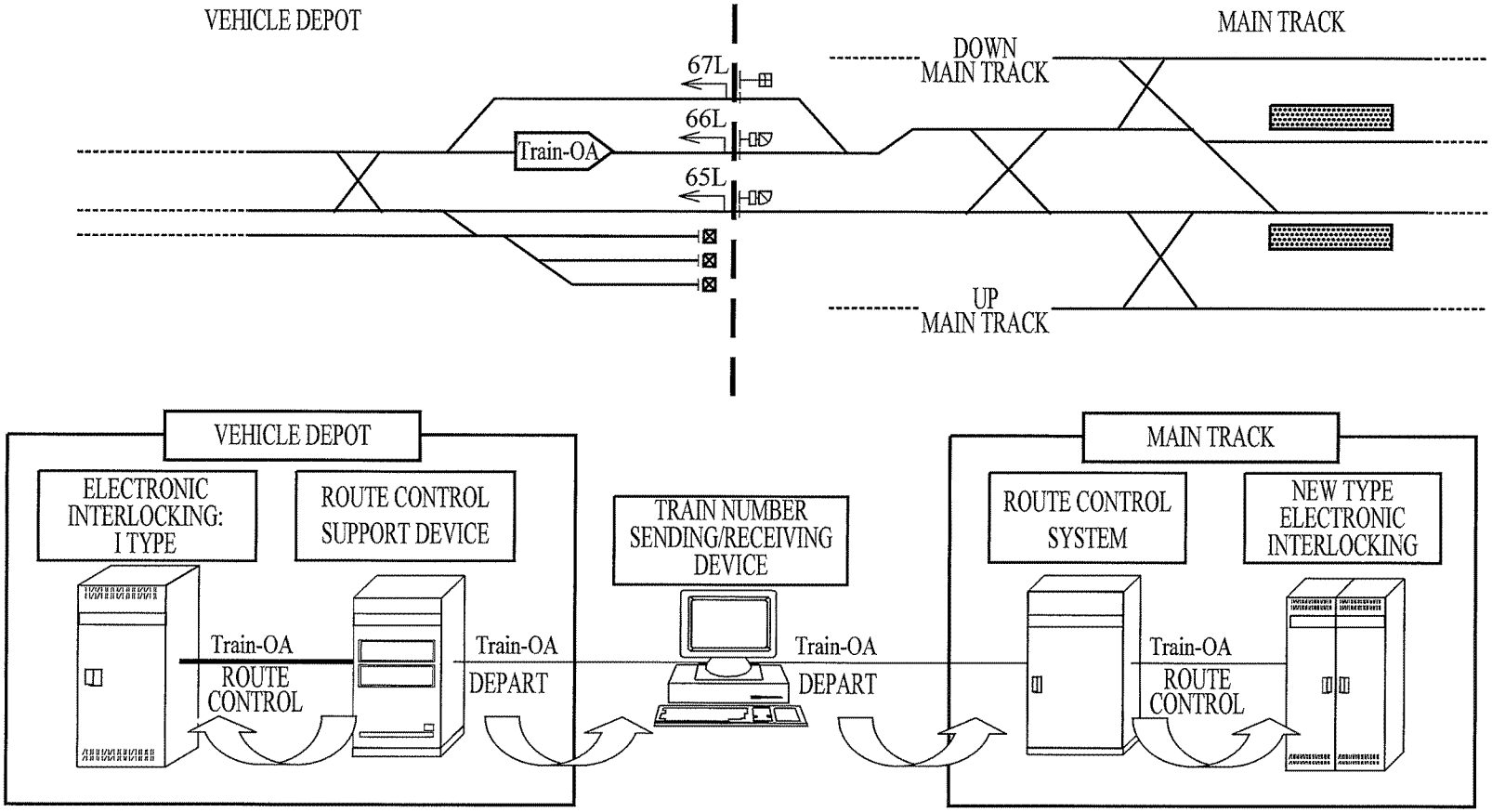
FIG. 17 is an illustration to explain a train tracking function 4.

Details of the train tracking function 4 are described with reference to FIG. 17.

There is a case where even in a line adopting the train operation control system 1 (adopting line), an interlocking device incompatible with the train operation control system 1 is used as an interlocking device for vehicle depots.

In such a case, the train number sending/receiving device which relays transmission of the train number information between the interlocking device for vehicle depots and the interlocking device 31 for main tracks is improved, whereby the interlocking device 31 for main tracks (the interlocking device compatible with the train operation control system 1) and the interlocking device for vehicle depots (the interlocking device incompatible with the train operation control system 1) can send/receive the train number information to/from one another. This prevents train numbers from being different therebetween and enables automatic route control.

<Train Tracking Function 5>

There has been a problem that the number of input points of track circuits at K station exceeds the upper limit of the system. That is, there has been a problem that, at the time of construction of the K station, the number of track circuits to be controlled by the K station device exceeds the upper limit value of the station device 30.

Hence, in an embodiment, in order to reduce the number of track circuits, a train tracking function 5 is provided which takes measures of [1] not including approach section track circuits in track circuits and [2] integrating and controlling between-stations track circuits in the ATC section, thereby making the number of track circuits less than the upper limit value.

Details of the train tracking function 5 are described with reference to FIG. 18.

The ATC section has a large number of track circuits, and if a station has a large number of track circuits in the station yard, the number thereof may exceed the track circuit control upper limit value (e.g., 160) of the station device 30.

Hence, in this embodiment, if the number of track circuits to be controlled by the station device 30 exceeds the control upper limit value of the station device 30, taking track circuit length, train length and so forth into account, the device 31 takes masseurs of [1] not including approach section track circuits in track circuits to control and [2] integrating and controlling between-stations track circuits in the ATC section, thereby reducing the number of track circuits to control and making the number thereof less than the upper limit value.

Here, the "approach section track circuit(s)" is constituted of some track circuits laid near a signal being integrated. However, the "approach section track circuit(s)" herein does not include a track circuit(s) laid near a signal(s) installed in the station yard.

Further, the "between-stations track circuit(s)" is a track circuit laid around the middle between stations.

Figure 18:
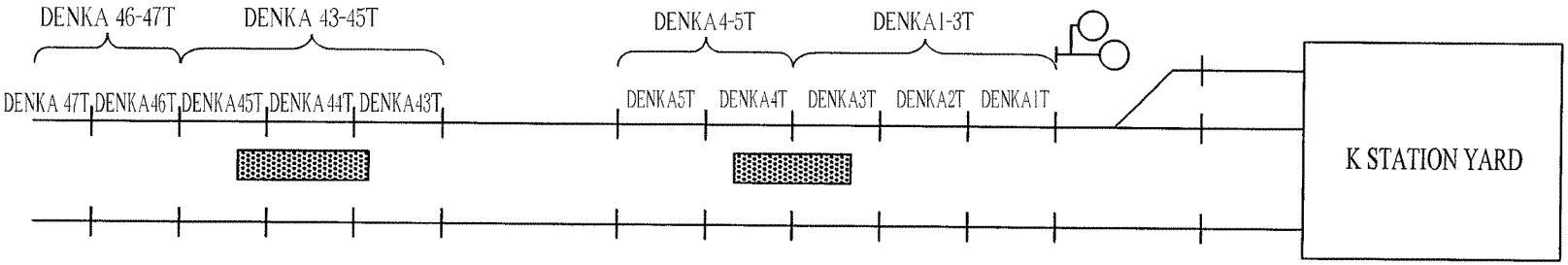
FIG. 18 is an illustration to explain a train tracking function 5.

For example, in the case shown in FIG. 18, "denka 1T" to "denka 3T" and "denka 4T" to "denka 5T" are approach section track circuits. Hence, the station device 30 installed in the K station integrates and controls the track circuits "denka 1T", "denka 2T" and "denka 3T" as a track circuit "denka 1-3T", and integrates and controls the track circuits "denka 41" and "denka 5T" as a track circuit "denka 4-5T". Accordingly, for example, signals from the track circuits "denka 1T", "denka 2T" and "denka 3T" are input to the station device 30 by OR operation, and signals from the track circuits "denka 4T" and "denka 5T" are input to the station device 30 by OR operation.

Further, in the case shown in FIG. 18, "denka 43T" to "denka 47T" are track circuits of the down track laid in the middle between stations. Hence, the station device 30 installed in the K station integrates and controls the track circuits "denka 43T", "denka 44T" and "denka 45T" as a track circuit "denka 43-45T", and integrates and controls the track circuits "denka 46T" and "denka 47T" as a track circuit "denka 46-47T". Accordingly, for example, signals from the track circuits "denka 431", "denka 44T" and "denka 45T" are input to the station device 30 by OR operation, and signals from the track circuits "denka 46T" and "denka 47T" are input to the station device 30 by OR operation.

The above-described interlocking device 31 of the embodiment(s) performs route control for trains based on: main track operation diagram information as train operation diagram information on a train which runs between stations; depot entry/departure operation diagram information as train (vehicle) operation diagram information on a train (vehicle) which moves in a station yard; and on-track position information on the trains, wherein the interlocking device 31 changes an order of the route control according to whether a predetermined condition is satisfied.

Hence, smooth train operation can be realized.

Note that the predetermined condition is not limited to the above-described conditions (the conditions presented in the description of the order determination functions 1 to 5 and the conditions presented in the description of the route control function 1), and can be appropriately changed.

Further, it is possible that the interlocking device 31 of the embodiment(s) includes a register unit (e.g., RAM) to register an order of passing through each point, wherein if an order of passing through a predetermined point (e.g., the point P1) registered in the register unit is a first train, a second train and a third train, and the first train, the second train and the third train pass through the predetermined point and proceed in a same direction, the interlocking device 31: taking the first train passing through the predetermined point as a trigger, determines whether the condition is satisfied, wherein the condition is that the third train is a train to connect to the first train; and when determining that the condition is not satisfied, performs the route control such that the third train passes through the predetermined point next to the second train in accordance with the order registered in the register unit; and when determining that the condition is satisfied, performs the route control such that the third train passes through the predetermined point before the second train against the order registered in the register unit (order determination function 1).

By this configuration, when the third train is the train to connect to the first train, the third train automatically passes through the predetermined point before the second train. Hence, even if the first train passes through the predetermined point before the second train because the second train is late or the like, the first train and the third train can connect to one another.

Further, it is possible that the interlocking device 31 of the embodiment(s) includes a register unit (e.g., RAM) to register an order of passing through each point, wherein if an order of passing through a predetermined diverging point (e.g., the point P2) registered in the register unit is a first train and a second train, the first train passes through the predetermined point while proceeding to a vehicle depot (draw-out track) from a main track, and the second train passes through the predetermined point while proceeding to a main track from a vehicle depot (draw-out track), the interlocking device 31: determines whether the condition is satisfied, wherein the condition is that the second train is present on a route which the first train takes after passing through the predetermined point, the route of the first train is a pre-specified route, and the second train is registered as second in the order of passing through the predetermined point; and when determining that the condition is not satisfied, the interlocking device 31 performs the route control such that the second train passes through the predetermined point next to the first train in accordance with the order registered in the register unit; and when determining that the condition is satisfied, deletes the registration of the first train from the register unit, and performs the route control such that the second train passes through the predetermined point before the first train (order determination function 2).

By this configuration, when the second train is present on the route which the first train takes after passing through the predetermined point, the route of the first train is a pre-specified route, and the second train is registered as No. 2 in the order of passing through the predetermined point, the second train automatically passes through the predetermined point before the first train. Hence, even if the first train is late or the like, the second train can depart without being late.

Further, it is possible that in the interlocking device 31 of the embodiment(s), when determining that a second train is present in a predetermined area (deadlock area) on a route of a first train before performing the route control on a predetermined section (entry section) for the first train, the interlocking device 31: determines whether the condition is satisfied, wherein the condition is that the second train is a train to connect to the first train; and when determining that the condition is not satisfied, performs the route control on the predetermined section for the first train after performing the route control for the second train whereby the second train moves out of the predetermined area (deadlock area); and when determining that the condition is satisfied, performs the route control on the predetermined section for the first train before performing the route control for the second train (order determination function 3).

By this configuration, even when the deadlock prevention function is ON, if the second train is the train to connect to the first train, the deadlock prevention function does not act, and route control for the first train is automatically performed even if the second train is in the predetermined area (deadlock area). Hence, the first train and the second train can connect to one another.

Further, it is possible that in the interlocking device 31 of the embodiment(s), when determining that a second train is present in a predetermined area (deadlock area) on a route of a first train before performing the route control on a predetermined section (entry section) for the first train, the interlocking device 31: determines whether the condition is satisfied, wherein the condition is that the first train is a train which makes a turn in the predetermined section and moves out of the predetermined section; and when determining that the condition is not satisfied, performs the route control on the predetermined section for the first train after performing the route control for the second train whereby the second train moves out of the predetermined area (deadlock area); and when determining that the condition is satisfied, performs the route control on the predetermined section for the first train before performing the route control for the second train (order determination function 4).

By this configuration, even when the deadlock prevention function is ON, if the first train is the train which makes a turn in the predetermined section and moves out of the predetermined section, the deadlock prevention function does not act, and route control for the first train is automatically performed even if the second train is present in the predetermined area (deadlock area). Hence, even if the second train is present in the predetermined area (deadlock area) due to the second train delay or the like, the first train can move out of the predetermined area without being late.

Further, it is possible that in the interlocking device 31 of the embodiment(s), when determining that a second train is present between a first train and a predetermined point (e.g., the point P51 or P52) in a predetermined section (entry section+overrun section) before performing the route control on the predetermined section for the first train, the interlocking device 31: determines whether the condition is satisfied, wherein the condition is that a route of the first train and a route of the second train diverge at the predetermined point; and when determining that the condition is not satisfied, performs the route control on the predetermined section for the first train in parallel with the route control for the second train; and when determining that the condition is satisfied, performs the route control on the predetermined section for the first train after performing the route control for the second train whereby the second train passes through the predetermined point (order determination function 5).

By this configuration, when the route of the first train and the route of the second train diverge at the predetermined point, route control for the first train is automatically performed after the second train passes through the predetermined point. Hence, even if the second train is present in the predetermined area due to the second train delay or the like, the second train can run along the scheduled proceeding direction.

Further, it is possible that in the interlocking device 31 of the embodiment(s), when determining that a second train is present in a predetermined section (entry section) before performing the route control on the predetermined section for a first train, the interlocking device 31: determines whether the condition is satisfied, wherein the condition is that, among a plurality of track circuits laid in the predetermined section, a track circuit (first track circuit) closest to the first train is energized; and when determining that the condition is not satisfied, defers the route control on the predetermined section for the first train until determining that the condition is satisfied, while keeping performing the route control for the second train; and when determining that the condition is satisfied, performs the route control on the predetermined section for the first train in parallel with the route control for the second train (route control function 1).

By this configuration, when, among the plurality of track circuits laid in the predetermined section, the track circuit closest to the first train (the first track circuit) is energized, route control for the first train is automatically performed in parallel with route control for the second train. Hence, the distance between the first train and the second train can be closed.

The interlocking device 31 of the embodiment(s) performs route control for trains based on: main track operation diagram information as train operation diagram information on a train which runs between stations; depot entry/departure operation diagram information as train (vehicle) operation diagram information on a train (vehicle) which moves in a station yard; and on-track position information on the trains, wherein the interlocking device 31 performs control with time on a signal and/or a switch on a route of a train based on different information according to whether a predetermined condition is satisfied.

Hence, smooth train operation can be realized.

Note that the different information according to whether the predetermined condition is satisfied is not limited to the above-described information (the information presented in the description of the order determination functions 6 and 7 and the information presented in the description of the route control function 2), and can be appropriately changed.

Further, it is possible that in the interlocking device 31 of the embodiment(s), the depot entry/departure operation diagram information contains: starting time as time at which an entering/departing train leaves a start point of an entry/departure route as a route of the entering/departing train entering or departing from a vehicle depot; and through time as time at which the train passes through a predetermined through place provided between the start point and an endpoint of the entry/departure route, and the interlocking device 31: determines whether the condition is satisfied, wherein the condition is that the through place for which through time is set is provided in the entry/departure route; and when determining that the condition is not satisfied, controls the signal and/or the switch in a section from the start point to the end point based on the starting time; and when determining that the condition is satisfied, controls the signal and/or the switch in a section from the start point to the through place based on the starting time, and controls the signal and/or the switch in a section from the through place to another through place or in a section from the through place to the end point based on the through time (order determination function 6).

By this configuration, quality of entry/departure control can be improved using the existing information (through time).

Further, it is possible that the interlocking device 31 of the embodiment(s) includes a register unit (e.g., RAM) to register an order of departure from a predetermined station, wherein if the order registered in the register unit is a first train and a second train, and the first train and the second train depart from tracks having different numbers, pass through a same point (e.g., the point P7) and proceed in a same direction, the interlocking device 31: determines whether the condition is satisfied, wherein the condition is that a plurality of starting signals is provided both between a departure point of the first train and the point and between a departure point of the second train and the point, and routes of the first train and the second train are pre-specified routes; and when determining that the condition is not satisfied, controls, based on the order registered in the register unit, the plurality of starting signals provided between the departure point of the second train and the point after the first train passes through a last starting signal among the plurality of starting signals provided between the departure point of the first train and the point; and when determining that the condition is satisfied, controls the plurality of starting signals provided between the departure point of the second train and the point based on departure time of the second train without waiting for the first train to pass through the last starting signal among the plurality of starting signals provided between the departure point of the first train and the point (order determination function 7).

By this configuration, the second train can depart as scheduled.

Further, it is possible that in the interlocking device 31 of the embodiment(s), if a plurality of shunting signals is provided on a departure route as a route of a train (departure vehicle) which departs from a vehicle depot, the interlocking device 31: determining whether the condition is satisfied, wherein the condition is that the plurality of shunting signals includes a specific shunting signal (shunting signal at an ATC switching place) to make the departing train make a stop; and when determining that the condition is not satisfied, controls the plurality of shunting signals provided on the departure route based on the depot entry/departure operation diagram information; and when determining that the condition is satisfied, controls the specific shunting signal based on the on-track position information on the departing train and an entry state of the departing train into a predetermined track circuit (start-point track circuit), and controls the plurality of shunting signals except the specific shunting signal based on the depot entry/departure operation diagram information (route control function 2).

By this configuration, the specific shunting signal (shunting signal at an ATC switching place) can be controlled at appropriate timing.

In the above, embodiments of the present invention are described. Needless to say, however, the present invention is not limited to the embodiments and can be modified in various aspects without departing from the spirit of the present invention.

For example, the interlocking device 31 does not need to have all of the order determination functions 1 to 7, the route control functions 1 and 2 and the train tracking functions 1 to 5, and may have one of these functions.

INDUSTRIAL APPLICABILITY

The present invention is applicable to an interlocking device which performs route control for trains based on train operation diagram information on trains and on-track position information on trains.

DESCRIPTION OF REFERENCE NUMERALS

10 Central Device
20 Line Central Device
30 Station Device
31 Interlocking Device

The invention claimed is:

1. An interlocking device comprising a controller configured to:

perform route control for trains with time on a signal or a switch on a route of a train based on different information according to whether a predetermined condition is satisfied, the different information including:

first operation diagram information as train operation diagram information on a train which runs between stations, second operation diagram information as train operation diagram information on a train which moves in a station yard, the second operation diagram information including: a starting time as time at which a train leaves a start point of an entry/departure route as a route of the train entering or departing from a vehicle depot, and a through time as time at which the train passes through a predetermined through place provided between the start point and an end point of the entry/departure route, and on-track position information on the trains, the controller performing route control by:

determining whether the predetermined condition is satisfied, the predetermined condition being that the through place for which through time is set is provided in the entry/departure route;

in response to determining that the predetermined condition is not satisfied, controlling the signal and/or the switch in a section from the start point to the end point based on the starting time; and in response to determining that the condition is satisfied, controlling the signal and/or the switch in a section from the start point to the through place based on the starting time, and controlling the signal and/or the switch in a section from the through place to another through place or in a section from the through place to the end point based on the through time.

2. An interlocking device comprising:

a register storing an order of departure from a predetermined station; and a controller configured to perform route control for trains with time on a signal or a switch on a route of a train based on different information according to whether a predetermined condition is satisfied, the different information including: (i) first operation diagram information as train operation diagram information on a train which runs between stations, (ii) second operation diagram information as train operation diagram information on a train which moves in a station yard, and (iii) on-track position information on the trains, in response to the order registered in the register being a first train and a second train, where the first train and the second train depart from tracks having different numbers, pass through a same diverging point and proceed in a same direction, the controller performs the route control by:

determining whether the predetermined condition is satisfied, the predetermined condition being that a plurality of starting signals is provided both between a departure point of the first train and the diverging point, and between a departure point of the second train and the diverging point, and routes of the first train and the second train are pre-specified routes;

in response to determining that the predetermined condition is not satisfied, controlling, based on the order registered in the register, the plurality of starting signals provided between the departure point of the second train and the diverging point after the first train passes through a last starting signal among the plurality of starting signals provided between the departure point of the first train and the diverging point; and in response to determining that the predetermined condition is satisfied, controlling the plurality of starting signals provided between the departure point of the second train and the diverging point based on departure time of the second train without waiting for the first train to pass through the last starting signal among the plurality of starting signals provided between the departure point of the first train and the diverging point.

3. An interlocking device comprising a controller configured to:

perform route control for trains with time on a signal or a switch on a route of a train based on different information according to whether a predetermined condition is satisfied, the different information including:

first operation diagram information as train operation diagram information on a train which runs between stations, second operation diagram information as train operation diagram information on a train which moves in a station yard, and on-track position information on the trains, in response to a plurality of shunting signals being provided on a departure route as a route of a departing train which departs from a vehicle depot, the controller performs the route control by:

determining whether the predetermined condition is satisfied, the predetermined condition being that the plurality of shunting signals includes a specific shunting signal to cause the departing train to make a stop;

in response to determining that the predetermined condition is not satisfied, controlling the plurality of shunting signals provided on the departure route based on the second operation diagram information; and in response to determining that the condition is satisfied, controlling the specific shunting signal based on the on-track position information on the departing train and an entry state of the departing train into a predetermined track circuit, and controlling the plurality of shunting signals except the specific shunting signal based on the second operation diagram information.

* * * * *